US011773652B2

(12) United States Patent
Piraccini et al.

(10) Patent No.: US 11,773,652 B2
(45) Date of Patent: Oct. 3, 2023

(54) DRILLING MACHINE PROVIDED WITH AN ELECTRICALLY-BRAKED MOVING DEVICE FOR THE DRILLING STRING

(71) Applicant: SOILMEC S.P.A., Cesena (IT)

(72) Inventors: Matteo Piraccini, Forli (IT); Alberto Antonelli, Cesena (IT); Francesco Mantovani, Cesena (IT)

(73) Assignee: SOILMEC S.P.A., Cesena (IT)

( * ) Notice: Subject to any disclaimer, the term of this patent is extended or adjusted under 35 U.S.C. 154(b) by 302 days.

(21) Appl. No.: 16/982,344

(22) PCT Filed: Mar. 19, 2019

(86) PCT No.: PCT/IB2019/052200

§ 371 (c)(1),
(2) Date: Sep. 18, 2020

(87) PCT Pub. No.: WO2019/180598

PCT Pub. Date: Sep. 26, 2019

(65) Prior Publication Data

US 2021/0025236 A1 Jan. 28, 2021

(30) Foreign Application Priority Data

Mar. 20, 2018 (IT) ..... 102018000003793

(51) Int. Cl.
*E21B 7/02* (2006.01)
*E21B 3/02* (2006.01)

(52) U.S. Cl.
CPC ..... *E21B 7/022* (2013.01); *E21B 3/022* (2020.05)

(58) Field of Classification Search
CPC .... E21B 19/008; E21B 41/0085; H02P 29/40; H02P 3/04
See application file for complete search history.

(56) References Cited

U.S. PATENT DOCUMENTS 4,545,017 A * 10/1985 Richardson ..... G01P 3/68 702/9
5,342,020 A * 8/1994 Stone ..... E21B 19/08 254/269

(Continued)

FOREIGN PATENT DOCUMENTS

GB 725453 A 3/1955
JP 2001240336 A 9/2001

(Continued)

OTHER PUBLICATIONS

International Search Report and Written Opinion dated Jul. 1, 2019 in PCT/IB2019/052200 filed Mar. 19, 2019, 13 pages.

(Continued)

*Primary Examiner* — Kipp C Wallace
(74) *Attorney, Agent, or Firm* — Element IP, PLC

(57) ABSTRACT

Drilling machine (1) comprising: a supporting structure (3); a drilling string (12); a drilling head (11); a flexible tensile element (17); a moving device (21), mechanically connected to the supporting structure (3) and mechanically associated with the flexible tensile element (17) to hold and move the drilling string (12); at least one first electric motor (22) configured to, in a first operating mode, actuate the moving device (21) so as to lift the drilling string (12), and configured to, in a second operating mode, apply a braking mechanical power on the moving device (21) so as to brake in a controlled manner the lowering of the drilling string (12) to reach and maintain a desired controlled lowering speed (Vd), the at least one first electric motor (22) being also configured to produce an electric power (Pmot); a first bidirectional electric power converter device (23) configured to convert the electric power produced (Pmot) into converted electric power (Pregen); an electric energy transmission network (24) arranged to transmit the converted electric power (Pregen); an electric power use unit (25)

(Continued)

arranged to receive said converted electric power (Pregen), the electric power use unit (25) comprising at least one first electric energy storage system (40) and a prime motor (50) configured to generate electric power; a control group (7) configured to send at least one first electric control signal representative of the value of the desired controlled lowering speed (Vd); a control system (60) configured to generate second electric control signals based on such a first electric control signal and send the second electric control signals to the first bidirectional electric power converter device (23) which is configured to control the operation of the first electric motor (22) based on said second electric control signals received from the control system (60), so that the drilling string (12) carries out the lowering at the desired controlled lowering speed (Vd), the control system (60) being of the distributed and real-time type.

15 Claims, 6 Drawing Sheets

(56) References Cited

U.S. PATENT DOCUMENTS

| | | | | |
|---|---|---|---|---|
| 6,968,905 | B2 | 11/2005 | Adnan et al. | |
| 2003/0057916 | A1* | 3/2003 | Davis | H02P 7/04 318/800 |
| 2004/0182574 | A1 | 9/2004 | Adnan et al. | |
| 2004/0226748 | A1* | 11/2004 | Prior | E21B 44/00 175/162 |
| 2008/0203734 | A1* | 8/2008 | Grimes | E21B 19/08 290/40 R |
| 2011/0074165 | A1 | 3/2011 | Grimes et al. | |
| 2016/0347163 | A1 | 12/2016 | Dorsett et al. | |
| 2016/0347167 | A1 | 12/2016 | Dorsett et al. | |
| 2016/0348336 | A1 | 12/2016 | Dorsett et al. | |
| 2017/0107692 | A1* | 4/2017 | Robertson | E02F 3/48 |
| 2017/0341504 | A1 | 11/2017 | Dorsett et al. | |
| 2018/0141431 | A1 | 5/2018 | Dorsett et al. | |
| 2018/0156023 | A1 | 6/2018 | Dykstra et al. | |
| 2019/0115758 | A1* | 4/2019 | Orban | H02J 9/066 |
| 2019/0309583 | A1* | 10/2019 | Netecke | E21B 19/008 |
| 2021/0172252 | A1* | 6/2021 | Caron | E21B 41/0085 |

FOREIGN PATENT DOCUMENTS

| | | | |
|---|---|---|---|
| JP | 2013520147 | A | 5/2013 |
| WO | WO-2008102166 | A1 | 8/2008 |
| WO | WO-2011034130 | A1 | 3/2011 |
| WO | WO-2016191732 | A1 | 12/2016 |
| WO | WO-2017142538 | A1 | 8/2017 |

OTHER PUBLICATIONS

Office Action dated Nov. 29, 2022 in Japanese Patent Application No. 2020-545139 (with English translation), 14 pages.

* cited by examiner

DRILLING MACHINE PROVIDED WITH AN ELECTRICALLY-BRAKED MOVING DEVICE FOR THE DRILLING STRING

The present invention relates to a drilling machine configured to drill a hole in the ground comprising a moving device of the drilling string moved by an electric motor configured to perform an electric braking of the drilling string during a lowering stroke at a controlled speed inside a hole.

Drilling machines configured to drill a hole in the ground are known comprising a supporting structure comprising a frame and a mast equipped with guides arranged for the sliding of a drilling head on said mast. This drilling head, called "rotary" in the drilling machines sector, is configured to translate in a guided manner along said mast and it is motorised to give a rotational motion and/or a translational motion to a drilling string. The supporting structure is moved in translation by means of a mobile assembly associated with the supporting structure itself. A prime motor associated with the supporting structure, typically a combustion engine, delivers the required power to all the machine's drives. Such known drilling machines are usually equipped with drilling tools (for example bucket, drill, core barrel, continuous flight auger) configured to drill a hole in the ground by means of different drilling techniques. After the drilling stage, this hole is filled with a cement mixture so that, following its solidification, a foundation pile is obtained. During drilling for the installation of foundation piles by means of using the so-called drilling technique with a continuous flight auger, indicated for example as "CFA or Continuous Flight Auger", or by means of using the so-called drilling technique with a cased continuous flight auger, indicated for example as "CAP or Cased Auger Pile", the drilling tool is made up of a continuous flight auger, also called "drilling string", which is mechanically connected to the drilling head in such a way as to be driven in rotation to drill the hole. For this purpose, the drilling string is of such a shape that it can be moved inside the hole itself along a substantially longitudinal direction of the hole. A flexible tensile element is connected to the drilling head and is arranged to hold and move this drilling head. Through the drilling head, the flexible tensile element is indirectly connected to said drilling string and is therefore arranged to hold and move the drilling string itself. The flexible tensile element moves said drilling string along a substantially longitudinal direction of the hole by means of a moving apparatus. This moving apparatus comprises a moving device, comprising for example a winch, moved by at least one hydraulic motor. The prime motor associated with the supporting structure uses the chemical energy of a fuel to supply the hydraulic power necessary to move said hydraulic motor. To drill the hole, the continuous flight auger is driven in rotation by the drilling head. Due to the "screw" geometry of the continuous flight auger, it is known that, during the lowering stroke of the drilling string inside the hole being formed, this continuous flight auger tends to spontaneously screw while advancing in the ground and if it is not properly retained, tends to advance without removing material. By retaining the flight auger by means of a braking action exerted by the moving apparatus through the flexible tensile element, each rotation carried out by a flight of the flight auger is forced to correspond to a longitudinal advancement of the flight auger which becomes smaller than the pitch of the flight itself. In this way the flight auger advances in the ground while removing material. During drilling for the installation of foundation piles of a large diameter, by means of using the drilling technique indicated for example as "LDP or Large Diameter Pile", the drilling tool typically consists of a bucket or a drill mechanically connected to tubular telescopic elements, referred to as "kelly" telescopic rods. The assembly consisting of these telescopic rods and the drilling tool is usually referred to as the "drilling string" and it is of such a shape that it can be moved inside the hole itself along a substantially longitudinal direction of the hole. This drilling string is directly connected to the flexible tensile element arranged to hold and move said drilling string inside the hole along a substantially longitudinal direction of the hole and moved by a moving apparatus, for example comprising a winch moved by at least one hydraulic motor. The prime motor associated with the supporting structure uses the chemical energy of a fuel to supply the hydraulic power necessary to move said hydraulic motor. The telescopic rods are equipped with longitudinal strips arranged to receive the rotational motion given by the drilling head. These telescopic rods are formed by at least two tubular elements which can translate coaxially with respect to one another, of which at least an external rod provided, at the upper end, with an external abutment collar arranged to come into contact with the drilling head and at least one internal rod arranged to slide coaxially inside the external rod. The external rod is also equipped at the lower end with an internal abutment arranged to come into contact with a collar present at the upper end of the internal rod in order to stop this relative coaxial sliding in an end-stroke position. The internal rod is configured at one end to be held by the flexible tensile element and is configured at the other end so as to transfer the rotational motion given by the drilling head to the drilling tool. During drilling carried out by using the drilling technique referred to as "LDP", i.e. by means of a drilling tool mechanically connected to tubular telescopic elements, the drilling string must be repeatedly and cyclically raised from the bottom of the hole to allow the emptying at ground level of the soil stored in the tool. Every time a drilling tool emptying step is completed and the drilling is to be continued, it is necessary to lower the drilling string back inside the hole so that the tool can come into contact again with the soil to be drilled. It must therefore be understood that this lowering and raising of the drilling string between ground level and the bottom of the hole must be repeated cyclically until the desired drilling depth is reached. In the initial part of the lowering stroke of the drilling string, the external rod rests on the internal rod by means of an external abutment present at the lower end of the internal rod and consequently the entire weight of the drilling string acts on the flexible tensile element. With the progression of the lowering stroke to greater depths, a depth is reached such that the external abutment collar present at the upper end of the external rod comes into contact with the drilling head and in doing so it prevents this external rod from further continuing the lowering, as it remains axially locked on the drilling head itself. At this point the further lowering of the drilling tool to greater depths can only continue by means of the coaxial sliding of the internal rod with respect to the external rod. The maximum lowering depth achievable by the drilling tool is reached when the internal rod is at the end-stroke position, that is, when the collar present at the upper end of this internal rod comes into contact with the internal abutment present at the lower end of the external rod. When the external rod comes into contact with the drilling head, the weight of this external rod no longer acts on the flexible tensile element and therefore on the moving device but it is transferred onto the drilling head. When the internal rod reaches the end-stroke position and comes into contact with the external rod, the weight of this internal rod no longer acts on the flexible tensile element and therefore on the moving device but it is transferred onto the drilling head. In fact, since the external rod comes into contact with the drilling head and the internal rod comes into contact, in the end-stroke position, with this external rod, it follows that the weight of the internal rod will be transferred onto the drilling head, in addition to the weight of the external rod. Since the drilling depth that can be reached with drilling machines of the known type by using the "LDP" drilling technique can be even greater than one hundred metres, it is usually necessary to use a drilling string comprising a plurality of tubular telescopic elements, up to having even five or six telescopic rods one inside the other, with a total mass of over twenty tons. To this end, the known type of drilling machine is arranged to be able to use a variety of drilling strings of different weights, depending on the drilling depth that must be reached. The high mass of the drilling string means that this drilling string would tend to spontaneously perform the lowering stroke due to its own weight, reaching however an excessive lowering speed. The deep drilling depths combined with such a high mass result in an enormous amount of gravitational potential energy possessed by the drilling string at the beginning of each lowering stroke. In drilling machines of the known type this enormous amount of energy is totally dissipated as heat by means of an overcenter valve, connected to the hydraulic circuit of the hydraulic motor which moves the moving device, which controls the lowering speed of the drilling string by exerting a braking action through an adjustment of the oil flow at the outlet of the motor itself. This overcenter valve acts on the basis of a pilot pressure controlled by the drilling machine operator by means of a control joystick. Since the pilot pressure required to control the lowering speed of the drilling string in drilling machines of the known type must be generated by means of a pump mechanically connected to the combustion engine, the control of the lowering speed of the drilling string requires fuel consumption. In addition, the use of an overcenter valve limits the variety of drilling strings which can be used in the known type of drilling machine and therefore it limits the achievable drilling depth. In fact it is not possible to use drilling strings having a weight greater than the weight which, taking into account a safety factor, would induce on the overcenter valve a pressure that would keep this valve always open, thus making it unable to control the lowering speed of the drilling string.

The dissipation of such a large amount of energy makes the known type of drilling machine globally inefficient from an energy perspective and this leads to a high fuel consumption of the combustion engine since the movement of the drilling string covers a substantial part of the working cycle of this type of machine. The use of a hydraulic motor to move the moving device is further affected by the problem of the low efficiency typical of this type of motor and of the low overall efficiency of the entire hydraulic system necessary for this type of drive due to the considerable pressure drops present in said hydraulic system. In addition, to limit the fuel consumption required to generate the pilot pressure of an overcenter valve it would be necessary to use an overcenter valve with a high pilot ratio. However, the use of a high pilot ratio can cause instability in the movement of the moving device when the weight of any telescopic element of the drilling string no longer acts on the flexible tensile element but it acts on the drilling head, causing a sudden variation of the weight acting on the flexible tensile element and therefore also on the moving device. To reduce the risk of such instability, therefore, an overcenter valve with a low pilot ratio is generally used. However, the use of an overcenter valve with a low pilot ratio entails the need to increase the pilot pressure generated by the pump, further increasing the fuel consumption used to drive the pump. Consequently, the known type of drilling machine suffers from the problem of using a large quantity of fuel to carry out the movement of the drilling string. The high fuel consumption leads to a high frequency of refueling operations and the associated machine downtimes cause low productivity in the known type of drilling machine. Along the lowering stroke of the drilling string it is essential to always guarantee a controlled lowering speed, i.e. it is necessary to control the lowering speed by applying a suitably controlled braking action on the drilling string so that the value of said controlled lowering speed coincides with a desired and limited value along the entire lowering stroke of the drilling string. Controlling the lowering speed along the entire lowering stroke of the drilling string inside the hole is necessary, first of all, to avoid destructive impacts between the telescopic elements of the drilling string and the drilling head. In fact, if the lowering speed of the telescopic rods was too high, for example due to a lowering at an uncontrolled speed, i.e. due to a "free fall", when any of the telescopic rods transfers its weight from the flexible tensile element onto the drilling head, the resulting impact occurring at this uncontrolled speed would be excessive and would cause damage to the drilling head itself. Secondly, the need to always guarantee a controlled lowering speed of the drilling string inside the hole is due to the need of avoiding damage to the walls of the hole being made in order to not compromise the quality of the foundation pile to be made. In fact, during the lowering of the drilling string inside the hole in a so-called "dry drilling", i.e. in the absence of a fluid sustaining the hole, the drilling tool may come into contact with the walls of the hole themselves, damaging them due to friction and causing the detachment by landslide of portions of soil from the wall itself; this damage increases as the lowering speed increases. Nevertheless during the lowering of the drilling string inside the hole in a so-called "fluid drilling", i.e. in the presence of a fluid that completely fills the hole in order to prevent the landslide of the walls, the turbulent movement of this fluid flowing between the drilling tool and the walls of the hole can cause erosion of the walls themselves during the passage of the drilling tool if the lowering speed of the drilling string inside the hole is excessive, causing a damage that increases as the lowering speed increases. The control of the lowering speed must be free from instability because any instability in the movement of the moving device can cause excessive oscillations of the value of the instantaneous lowering speed with respect to the desired value of the controlled lowering speed. Also due to such excessive speed oscillations, it may happen that a telescopic element of the drilling string transfers its weight onto the drilling head with an excessively high speed causing an impact which damages the drilling head itself or it may happen that the walls of the hole being made gets damaged. It will be understood that repairing such damage causes machine downtime and therefore low productivity of the known type of drilling machine. On the other hand, it is instead essential to maximise the lowering speed of the drilling string inside the hole so as to reduce the time that is not usefully employed in drilling the hole. It must therefore be understood that it is essential to always guarantee a lowering speed which is controlled and free from instability, i.e. which is such that no destructive impacts of the telescopic elements on the drilling head occur and such that the walls of the hole being made does not get damaged, but still sufficient to guarantee high productivity of the drilling machine. In the known type of drilling machine, controlling the controlled lowering speed of the drilling string by means of a pilot pressure is affected by response delays caused by the compressibility of the hydraulic oil, by the elasticity of the pipes affected by the pressure of the oil itself and by the mechanical delays in the actuation of the valves and hydraulic distributors. All this leads to the fact that the known type of drilling machine poorly controls the controlled lowering speed of the drilling string inside the hole, both from the point of view of readiness and from that of the accuracy and stability of such control.

An object of the present invention is to overcome the aforementioned drawbacks and in particular to invent a drilling machine capable of reducing fuel consumption with respect to the drilling machines of the prior art and also capable of improving the control of the lowering speed of the drilling string inside the hole. Another object of the present invention is to invent a drilling machine having higher productivity than the known type of drilling machines.

These and other objects according to the present invention are obtained by making a drilling machine as recited in claim 1.

Further features of the drilling machine are the subject matter of the dependent claims.

The features and advantages of a drilling machine according to the present invention will be more apparent from the following description, which is to be understood as exemplifying and not limiting, with reference to the schematic attached drawings, wherein.

Figure 1:
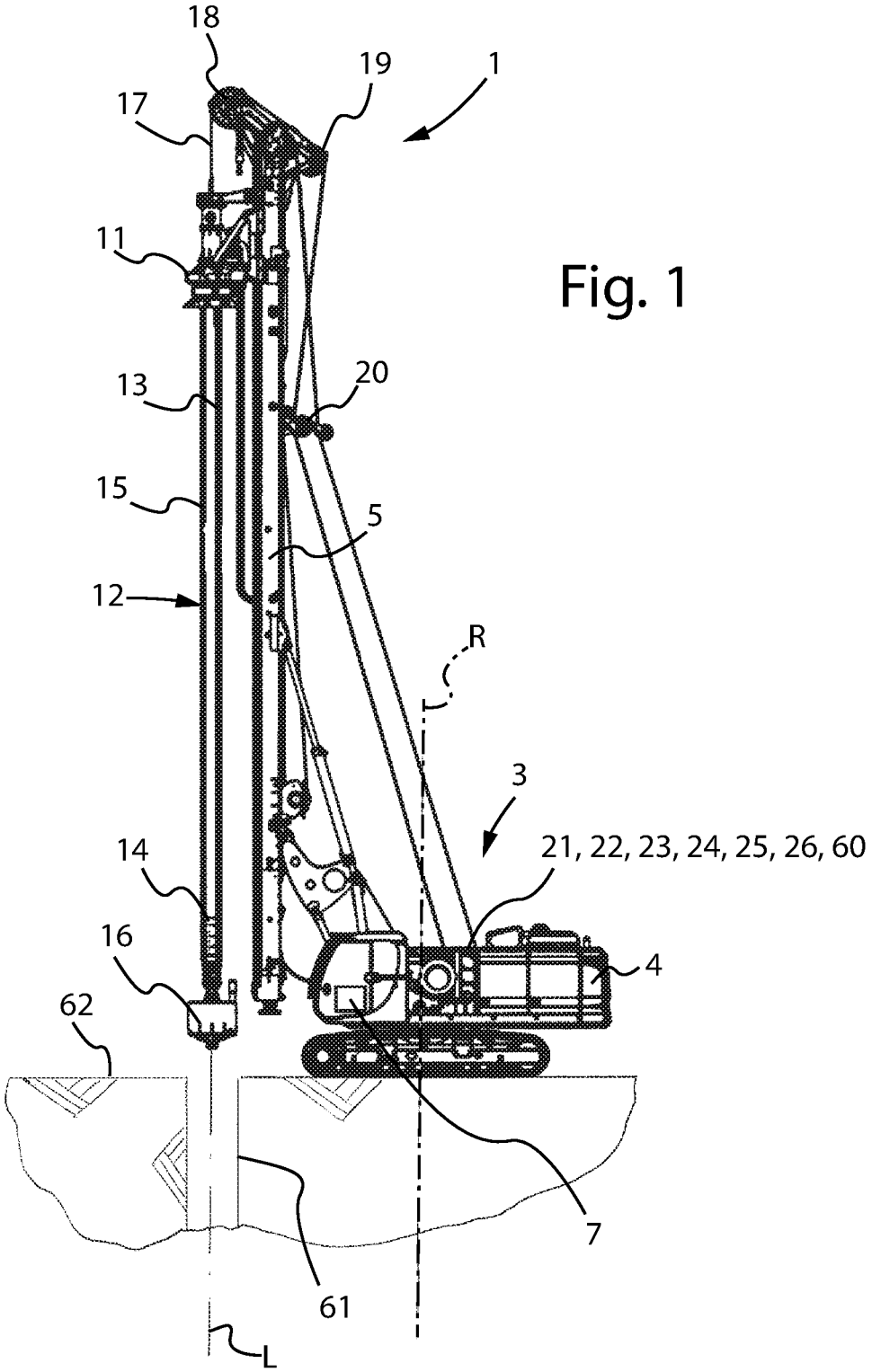
FIG. 1 represents a drilling machine according to the present invention.

With reference to the figures, a drilling machine according to the present invention is shown, indicated as a whole with 1. The drilling machine 1 comprises a mobile assembly 2 and a supporting structure 3. The mobile assembly 2, typically an undercarriage, is mechanically connected to the supporting structure 3 and it is motorised to perform the translation movement of the supporting structure 3 itself on the ground. The supporting structure 3 is mechanically connected to the mobile assembly 2 in a fixed way or in a way such that it can be rotated about an axis R; this supporting structure 3 comprises a frame 4 and a mast 5 provided with guides 10. A control station 6, for example a cab, is mechanically connected to the frame 4 and comprises at least a control group 7 comprising at least one control device 8, for example a joystick and/or a pedal, and a human-machine graphical interface 9 called "HMI", for example a control panel or a keypad, both operable by an operator. The drilling machine 1 further comprises a drilling head 11 configured to translate in a guided manner along said mast 5 by means of said guides 10 and motorised to give a rotational motion and/or a translational motion to a drilling string 12. This drilling string 12 is of a shape such that it can be moved inside a hole 61 along a direction L substantially longitudinal to the hole itself. This drilling string 12 can be actuated by said drilling head 11 to drill said hole. In particular, the drilling string 12 shown in FIG. 1 comprises, merely by way of example, an external telescopic rod 13 and an internal telescopic rod 14, both provided with longitudinal strips 15, and also comprises a drilling tool 16 connected to the internal telescopic rod 14. By means of such longitudinal strips 15, these telescopic rods 13 and 14 are arranged to receive the rotational motion given by the drilling head 11 and transfer this rotational motion to the drilling tool 16 and they are also arranged to allow a relative coaxial translation of the internal rod 14 with respect to the external rod along the longitudinal axis of these rods. The drilling machine 1 further comprises a flexible tensile element 17, typically a metal wire rope, returned along the mast 5 by means of sheaves 18,19,20 and arranged to hold and move the drilling string 12. The drilling machine 1 also comprises a moving device 21, for example a winch, mechanically connected to the supporting structure 3 and mechanically associated with the flexible tensile element 17, and it further comprises a first electric motor 22. The first electric motor 22 can be directly mechanically connected to the moving device 21 or it can be indirectly mechanically connected to the moving device 21 by means of a gearbox 34 not shown in the figure. The moving device 21 can be moved by the first electric motor 22 to move the drilling string 12 along the direction L substantially longitudinal to the hole itself by means of the flexible tensile element 17. A mechanical parking brake not shown in the figure, merely by way of example a mechanical brake with electromagnetic control, is mechanically associated with the moving device 21 and it is configured to completely stop the movement of this moving device 21 and to hold the weight of the drilling string 12 by means of the flexible tensile element 17, being automatically engaged when the speed of the moving device itself becomes lower than a minimum threshold value or when emergency braking is required. The moving device 21 shown in the attached figures is mechanically connected to the frame 4 but could be mechanically connected to the mast 5. The first electric motor 22 is configured to, in a first operating mode, actuate the moving device 21 so as to lift the drilling string 12 by means of the flexible tensile element 17, and configured to, in a second operating mode, apply a braking mechanical power on the moving device 21 so as to brake in a controlled manner, by means of the flexible tensile element 17, the lowering of the drilling string 12 to reach and maintain a desired controlled lowering speed Vd. The first electric motor 22 is further configured to produce an electric power Pmot in the second operating mode. In particular, the first electric motor 22 applies the braking mechanical power on the moving device 21 and converts this braking mechanical power into the electric power produced Pmot.

The first electric motor 22 can brake said drilling string 12 during a lowering stroke at a desired controlled speed both in a lowering phase in the hole 61 and in a lowering phase outside the hole 61, i.e. also when the drilling tool 16 is located above the ground level 62, for example during an emptying step on the ground level 62 of the soil stored in the drilling tool 16.

The first electric motor 22 is electrically connected to a first bidirectional electric power converter device 23 comprising electronic power devices controllable by means of electric control signals, such as for example thyristors (SCR, GTO) or transistors (IGBT, FET, MOSFET, BJT). This first bidirectional electric power converter device 23 is in turn electrically connected to an electric energy transmission network 24, called "link". The first bidirectional electric power converter device 23 is configured to convert the electric power produced Pmot by the first electric motor 22 into a converted electric power Pregen and further configured to input this converted electric power Pregen into the link 24. For example, the first bidirectional electric power converter device 23 can be configured as an AC/DC converter, to convert at least the form of the voltage and of the current of the produced electric power Pmot, or it can be configured as an AC/AC or DC/DC converter, to convert at least the intensity of the voltage and of the current of the produced electric power Pmot.

Figure 2:
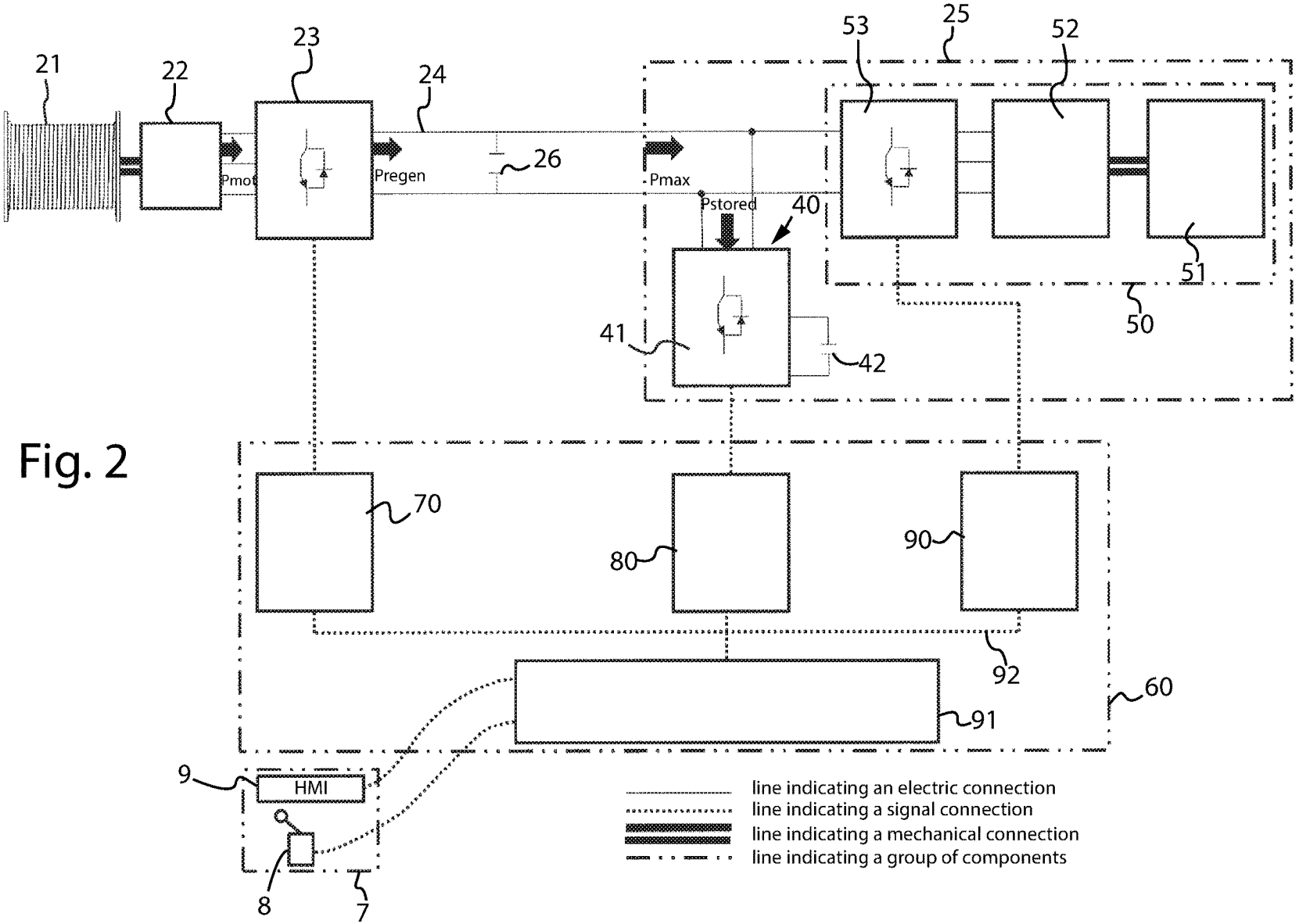
FIG. 2 is a block diagram illustrating a moving device, a first electric motor, a first bidirectional electric power converter device, an electric energy transmission network, a control system, a control group and an electric power use unit which are comprised in the drilling machine of FIG. 1 and configured according to a first embodiment of the present invention.

An electric power use unit 25 is electrically connected to the link 24 and is arranged to receive the electric power converted Pregen by the first bidirectional electric power converter device 23. The link 24 is electrically connected to the first bidirectional electric power converter device 23 and is arranged to transmit, to the electric power use unit 25, the electric power converted Pregen by the first bidirectional electric power converter device 23. The electric power use unit 25 comprises at least one first electric energy storage system 40 and a prime motor configured to generate electric power 50. The first electric energy storage system 40 comprises at least one second bidirectional electric power converter device 41 comprising electronic power devices controllable by means of electric control signals, such as for example thyristors (SCR, GTO) or transistors (IGBT, FET, MOSFET, BJT), and at least one first storage unit 42 associated with said at least one second bidirectional electric power converter device 41. This first storage unit 42 can be a first unit of supercapacitors which comprises a multiplicity of supercapacitors, merely by way of example electric double layer capacitors, electrically connected together in series and/or in parallel or it can be a first unit of secondary batteries which comprises a multiplicity of secondary batteries, merely by way of example lithium batteries of the Li-Ion or Li—FePO4 type or pure lead batteries, electrically connected together in series and/or in parallel. In the first embodiment of the present invention, as can be seen in FIG. 2, the prime motor 50 comprises at least a combustion engine 51, for example a diesel engine, a second electric motor 52 mechanically connected to said combustion engine 51 and further comprises a third electric power converter device 53, electrically associated with said second electric motor 52, comprising electronic power devices controllable by means of electric control signals, such as for example thyristors (SCR, GTO) or transistors (IGBT, FET, MOSFET, BJT). In particular, this third electric power converter device 53 could be bidirectional but, alternatively, it could be unidirectional.

The control group 7 is configured to send at least one first electric control signal representative of the value of the desired controlled lowering speed (Vd) of said drilling tool 16.

The drilling machine 1 also comprises a control system arranged to control the movement of the moving device 21. In particular, the control system 60 is configured to receive the first electric control signal, generate second electric control signals based on this first electric control signal and send these second electric control signals to the first bidirectional electric power converter device 23; the first bidirectional electric power converter device 23 is in fact configured to control the operation of the first electric motor 22 based on the received second electric control signals in order to carry out the lowering of the drilling string 12 at the desired controlled speed Vd.

Advantageously, the control system 60 comprises at least a first embedded control unit 70 associated with the first bidirectional electric power converter device 23; in this case, this first embedded control unit 70 is configured to generate the second electric control signals.

Preferably, the control system 60 is of the distributed type, i.e. it is provided with a plurality of embedded control units each arranged to control a component of the drilling machine 1. In this case, the distributed control system is of the real-time type, i.e. it is arranged to allow an exchange of communication data between the various embedded control units within predefined time periods. The advantages of this type of control system 60 architecture when it is applied to each embodiment of the present invention will be illustrated below.

In the first embodiment of the present invention, the control system 60 also comprises a second embedded control unit 80 associated with the second bidirectional electric power converter device 41, a third embedded control unit 90 associated with the third electric power converter device 53, a central control unit 91, for example a PLC having safety functions, and a communication system 92 arranged to transfer communication data by means of at least one communication protocol, possibly also by means of a multiplicity of different communication protocols. In particular, this communication system 92 is arranged to transfer the communication data between the embedded control units 70, 80, 90 and between each embedded control unit 70, 80, 90 and the central control unit 91. The real-time control system 60 is arranged to allow the exchange of communication data between the various embedded control units 70, 80, 90 and between each embedded control unit 70, 80, 90 and the central control unit 91 within predefined time periods. Advantageously, but not in a limiting sense, the first bidirectional electric power converter device 23 and the first embedded control unit 70 are housed inside a first common enclosure 27, the second bidirectional electric power converter device 41 and the second embedded control unit 80 are housed inside a second common enclosure 28, the third electric power converter device 53 and the third embedded control unit 90 are housed inside a third common enclosure 29. Such common enclosures 27, 28, 29 can be, for example, electrical switchboards, electrical boxes or electrical cabinets of the known type.

The first embedded control unit 70 comprises, for example, at least one DSP and/or one microprocessor and/or one microcontroller and/or one FPGA; this first embedded control unit 70 is programmed, i.e. it comprises a computer control program loaded into a memory unit of the first embedded control unit 70. This computer control program comprises a plurality of calculation modules, i.e. a plurality of groups of calculation instructions which contribute to the control of the first bidirectional electric power converter device 23. These calculation modules do not necessarily have to be executed in succession of one another according to a predetermined sequence; however, it is possible that the calculation instructions of a calculation module depend on the results of the calculation instructions of another calculation module. In the latter case, in fact, the execution of a calculation module may be dependent on the previous execution of one or more "preparatory" calculation modules. The control program of the first embedded control unit 70 comprises at least a speed limiting module 71, a speed regulating module 72, a torque regulating module 73, an electric power limiting module 75, a first module for generating electric control signals 77A, an instantaneous position and speed derivation module 78 and an acceleration and deceleration limiting module 79.

The second embedded control unit 80 comprises, for example, at least one DSP and/or one microprocessor and/or one microcontroller and/or one FPGA; this second embedded control unit 80 is programmed, i.e. it comprises a computer control program loaded into a memory unit of the second embedded control unit 80. This computer control program comprises a plurality of calculation modules, i.e. a plurality of groups of calculation instructions which contribute to the control of the second bidirectional electric power converter device 41. The control program loaded in the second embedded control unit 80 comprises at least a first link voltage regulating module, a first current limiting module, a second module for generating electric control signals and a first thermal management module. The central control unit 91 is electrically connected at least to the control group 7, i.e. it is electrically connected to the control device 8 and to the HMI 9, and to the communication system 92. This communication system 92 is electrically connected at least to the first embedded control unit 70, the second embedded control unit 80, the third embedded control unit 90 and the central control unit 91.

Figure 3:
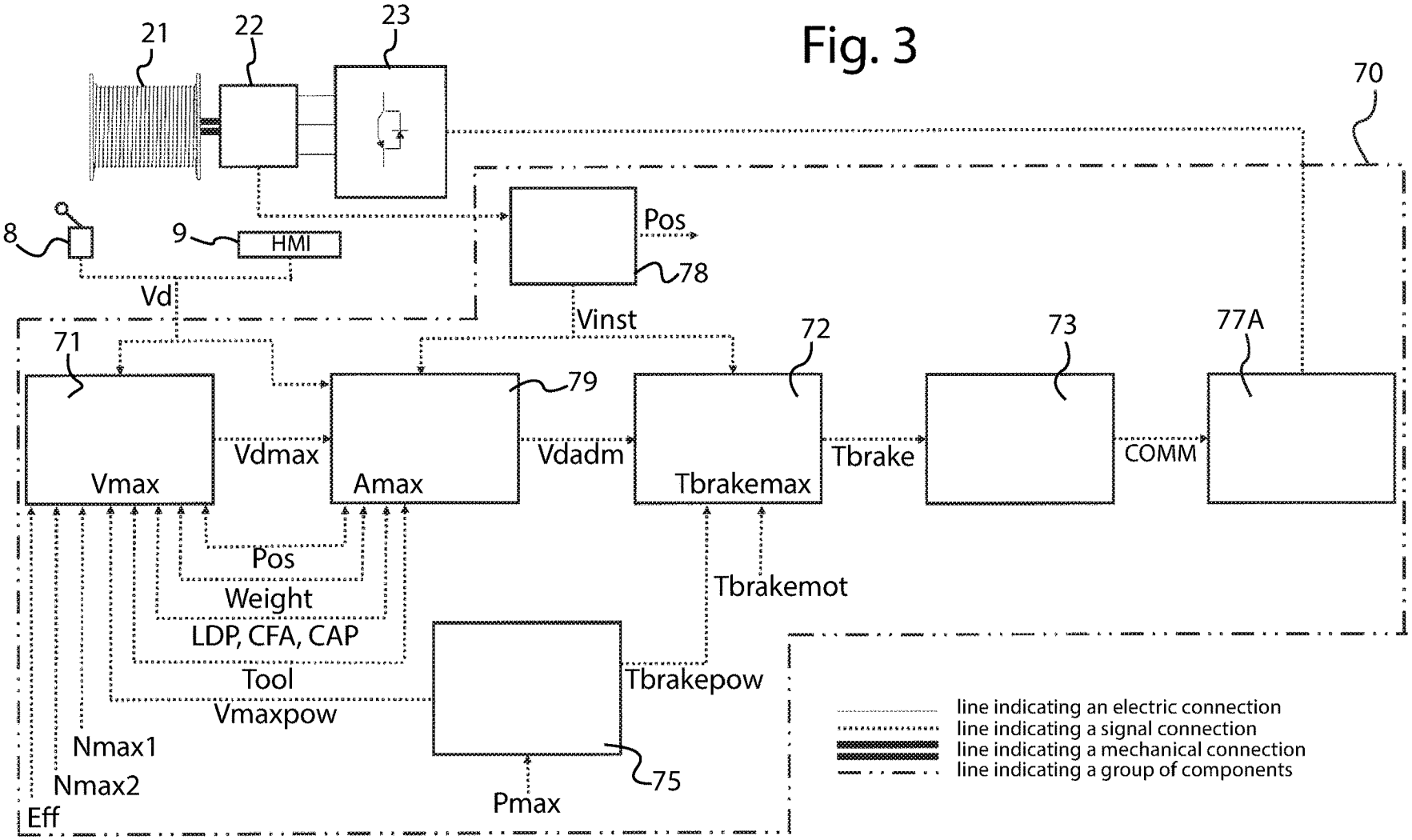
FIG. 3 is a block diagram representing a first embedded control unit of the drilling machine of figure and some components of such a drilling machine; in particular, the first embedded control unit is represented by a plurality of functional blocks that correspond to the calculation modules of the computer control program loaded into the first embedded control unit.

The operation of the drilling machine 1 according to the first embodiment is explained below with reference to FIGS. 1 to 3. Once the emptying step of the soil stored in the drilling tool 16 has been completed on ground level 62 and after having positioned the drilling string at the longitudinal axis L of the hole 61, the operator actuates the control device 8 or the HMI 9 in order to give the desired value of the controlled lowering speed of the drilling tool 16 inside the hole.

The control group 7 is configured to send a first electric control signal to the central control unit 91 representative of the desired value of the controlled lowering speed Vd of the drilling tool 16 inside the hole. It will be understood that, if the drilling tool is mechanically connected to "kelly" telescopic rods, the desired value of the controlled lowering speed Vd of the drilling tool 16 coincides with the desired value of the controlled lowering speed of each telescopic rod 13, 14 as long as the weight of each rod acts on the flexible tensile element 17 and not on the drilling head 11.

The first electric control signal is received by the central control unit 91 to verify the compatibility of this first electric control signal with the operating status of the drilling machine 1. If this first electric control signal is compatible with the operating status of the drilling machine, the central control unit 91 sends, by means of the communication system 92, this first electric control signal to the first embedded control unit 70 to be received and processed by the control program. According to a first alternative, the control group 7 is configured to send this first electric control signal to the communication system 92. In the latter case the communication protocol is configured to send this first electric control signal to the central control unit 91 and only if it is compatible with the operating status of the drilling machine 1 it will be sent to the first embedded control unit 70 to be received and processed by the control program. According to a further alternative, the control group 7 is configured to send the first electric control signal directly to the first embedded control unit 70 in order to be received. In this case, the first electric control signal is also forwarded to the central control unit 91 by the first embedded control unit 70 or by the control group 7. In particular, if this first electric control signal is compatible with the operating status of the drilling machine 1, the central control unit 91 sends to the first embedded control unit 70 a signal representative of the compatibility of the situation so that the control program loaded in the first embedded control unit 70 processes said first electric control signal only after receiving this signal representative of the compatibility of the situation. It must therefore be understood that, in any case, the first electric control signal is processed by the first embedded control unit 70 only following the verification of compatibility of this first electric control signal with the operating status of the drilling machine 1. This first embedded control unit 70 receives said first electric control signal and processes the desired value of the controlled lowering speed Vd by means of the speed limiting module 71. Said speed limiting module 71 is configured to compare the desired value of the controlled lowering speed Vd with a maximum value of the controlled lowering speed Vmax. This maximum value of the controlled lowering speed Vmax is determined by the speed limiting module 71 based on at least one parameter among the position Pos of the drilling tool 16, the instantaneous weight Weight acting on the flexible tensile element 17, the maximum permissible rotational speed Nmax1 of the moving device 21 or of the gearbox 34, the maximum permissible rotational speed Nmax2 of the first electric motor 22, the type of drilling technique used LDP, CFA, CAP, the type of drilling tool Tool used, the energy efficiency Eff of the first electric motor 22 and the maximum electric power usable Pmax by the electric power use unit 25. The position Pos of the drilling tool 16, i.e. its level compared to the ground level 62, can be advantageously determined by the instantaneous position and speed derivation module 78, or, similarly to the drilling machines of the known type, by means of the use of a depth sensor associated with the moving device 21. The instantaneous weight Weight acting on the flexible tensile element 17 can be determined by means of a signal sent by a load sensor, for example by a load cell mechanically connected to any of the sheaves 18,19,20 or by any load sensor mechanically connected to the moving device 21 or to the gearbox 34. Alternatively, the instantaneous weight Weight acting on the flexible tensile element 17 can be determined by the first embedded control unit 70 based on the position Pos of the drilling tool 16 and on the basis of parameters stored within the first embedded control unit 70 and entered by the operator by means of the HMI 9, such as the number of telescopic rods used, the weight and length of each telescopic rod. Advantageously, the instantaneous weight Weight acting on the flexible tensile element 17 can be determined by the first embedded control unit 70 by means of a mathematical model, for example through the equations of motion for the dynamics of the moving device 21 or the gearbox 34 or the first electric motor 22 or the drilling string 12 or the flexible tensile element 17. The maximum permissible rotational speed Nmax1 of the moving device 21 or of the gearbox 34 and the maximum permissible rotational speed Nmax2 of the first electric motor 22 can be advantageously determined on the basis of predetermined values stored within the first embedded control unit 70 and inserted by means of a control panel electrically associated with the first embedded control unit 70 itself. The type of drilling technique used LDP, CFA, CAP can be determined on the basis of input parameters entered by means of the HMI and representative of the type of drilling technique used, for example the type of drilling tool used (for example bucket, drill, continuous flight auger) or representative of the adopted configuration of the drilling machine (for example "LDP" or "CFA" or "CAP") or, more generally, based on any HMI configuration designed for the operator's selection of the type of drilling technique used. The type of drilling tool Tool used can be determined based on input parameters entered by means of the HMI and representative of the geometry of the drilling tool 16, for example the diameter, height, pitch of the flight of the continuous flight auger and the weight. The energy efficiency Eff of the first electric motor 22 can be determined by the first embedded control unit 70 on the basis of tables stored within the first embedded control unit 70 and indicating the energy efficiency of this first electric motor 22 at least with the varying of the rotational speed of said first electric motor 22 and the varying of the braking torque produced by said first electric motor 22 or it can be calculated on the basis of a mathematical model designed to determine the energy efficiency of the first electric motor 22 at least with the varying of the rotational speed and of the braking torque produced. The value of the maximum electric power usable Pmax by the electric power use unit 25 can be advantageously received by the electric power limiting module 75 and this electric power limiting module 75 can send to the speed limiting module 71 a maximum value of the controlled lowering speed based on the maximum electric power usable by the electric power use unit Vmaxpow. The speed limiting module 71 is further configured to determine the value of a desired maximum speed Vdmax on the basis of the comparison between the desired value of the controlled lowering speed Vd and the maximum value of the controlled lowering speed Vmax. The instantaneous position and speed derivation module 78 is configured to determine a value representative of the instantaneous lowering speed Vinst of the drilling tool 16 inside the hole and to determine the position Pos of the drilling tool 16 itself, i.e. its level compared to the ground level 62. This instantaneous position and speed derivation module is further configured to send the value representative of the instantaneous lowering speed Vinst of the drilling tool 16 to the acceleration and deceleration limiting module 79 and/or to the speed regulating module 72 and it is further configured to send the value of the position Pos of the drilling tool to the speed limiting module 71 and/or to the acceleration and deceleration limiting module 79. In a first case, the instantaneous position and speed derivation module 78 is configured to determine the value representative of the instantaneous lowering speed Vinst of the drilling tool 16 and the position Pos of the drilling tool 16 itself on the basis of an electric signal sent by a depth sensor of a known type connected to the moving device 21, for example an encoder mechanically connected to the winch drum. In a second case, the instantaneous position and speed derivation module 78 is configured to determine the instantaneous angular position Posrot and the instantaneous angular speed Vrot of the rotor of the first electric motor 22 on the basis of an electric signal sent by a sensor connected to this rotor, for example an encoder or a resolver, or on the basis of an estimator or an observer of the instantaneous angular position of the rotor itself. In this second case, the instantaneous position and speed derivation module 78 is configured to determine the position Pos of the drilling tool 16, i.e. its level compared to the ground level 62, on the basis of the instantaneous angular position Posrot of the rotor of the first electric motor 22 and it is further configured to determine the value representative of the instantaneous lowering speed Vinst of the drilling tool 16 on the basis of the instantaneous angular speed Vrot of the rotor of the first electric motor 22. Advantageously but not limitedly, the instantaneous position and speed derivation module 78 is further configured to determine the instantaneous angular position Posrot and the instantaneous angular speed Vrot of the rotor of the first electric motor 22 also at very low instantaneous angular speeds, even at a zero instantaneous angular speed. It will be understood that, since the position Pos of the drilling tool 16 can be determined on the basis of the instantaneous angular position Posrot of the rotor of the first electric motor 22, it is advantageously possible to avoid using a sensor of a known type connected to the moving device, with consequent reduction in costs. In any case it will be understood that, if the drilling tool 16 is mechanically connected to "kelly" telescopic rods, the value representative of the instantaneous lowering speed Vinst of the drilling tool 16 coincides with the value representative of the instantaneous lowering speed of each telescopic rod 13, 14 as long as the weight of each telescopic rod acts on the flexible tensile element 17 and not on the drilling head 11. The acceleration and deceleration limiting module 79 is configured to determine the value of a desired acceleration or desired deceleration Ad based on the value of the desired maximum speed Vdmax, therefore also on the basis of the desired value of the controlled lowering speed Vd, and based on the value representative of the instantaneous lowering speed Vinst. This acceleration and deceleration limiting module 79 is further configured to determine a maximum value of the acceleration and/or deceleration Amax on the basis of at least one parameter among the position Pos of the drilling tool 16, the instantaneous weight Weight acting on the flexible tensile element 17, the type of drilling technique used LDP, CFA, CAP, the type of drilling tool Tool used and it is also configured to determine the admissible value of the desired controlled lowering speed Vdadm based on the comparison between the value of the desired acceleration or desired deceleration Ad and the maximum value of the acceleration and/or deceleration Amax. The speed regulating module 72 comprises a controller, by way of example a proportional-integrative, proportional-integrative-derivative, hysteretic or fuzzy controller. By means of this controller, the speed regulating module 72 is configured to compare the admissible value of the desired controlled lowering speed Vdadm with the value representative of the instantaneous lowering speed Vinst and to determine a desired value of the braking torque produced by said first electric motor 22 on the basis of this comparison. The speed regulating module 72 is further configured to determine a maximum value of the produced braking torque Tbrakemax on the basis of at least one parameter among the maximum electric power usable Pmax by the electric power use unit 25 and the maximum braking torque applicable Tbrakemot by said first electric motor 22. The value of the maximum electric power usable Pmax by the electric power use unit 25 can be advantageously received by the electric power limiting module 75 and this electric power limiting module 75 can send to the speed regulating module 72 a maximum value of the produced braking torque based on the maximum electric power usable by the electric power use unit Tbrakepow. The maximum braking torque applicable Tbrakemot by said first electric motor 22 can be determined by the first embedded control unit 70 on the basis of tables stored within the first embedded control unit 70 and indicating the maximum braking torque applicable by said first electric motor 22 at least with the varying of the rotational speed of said first electric motor 22 and/or with the varying of the duty type of said first electric motor 22 according to IEC standards of a known type and/or with the varying of at least one temperature of said first electric motor 22. This at least one temperature of the first electric motor 22 can be determined by the first embedded control unit 70 on the basis of an electric signal sent by a temperature sensor associated with said first electric motor 22 or it can be calculated on the basis of a mathematical model designed for calculating at least one temperature based on electric parameters of this first electric motor 22. The speed regulating module 72 is further configured to determine a reference value of the braking torque produced Tbrake by said first electric motor 22 on the basis of the comparison between the desired value of the braking torque produced and the maximum value of the braking torque produced Tbrakemax. The first embedded control unit 70 is therefore configured to control the instantaneous value of the controlled lowering speed of the drilling tool during at least one lowering stroke into the hole by means of the speed regulating module 72. The electric power limiting module 75 is configured to limit the electric power produced Pmot by said first electric motor 22 and converted Pregen by the first bidirectional electric power converter device 23 to a value not greater than the maximum electric power usable Pmax by said electric power use unit 25. To this end, the electric power limiting module 75 is configured to receive a signal representative of the value of the maximum electric power usable Pmax by said electric power use unit 25 and it is further configured to limit the maximum value of the controlled lowering speed Vmax determined by the speed limiting module 71 and/or to limit the reference value of the produced braking torque Tbrake determined by the speed regulating module 72 on the basis of the maximum electric power usable Pmax by said electric power use unit 25. To this end, the electric power limiting module 75 is configured to generate a maximum value of the controlled lowering speed based on the maximum electric power usable by the electric power use unit Vmaxpow and/or a maximum value of the produced braking torque based on the maximum electric power usable by the electric power use unit Tbrakepow. The torque regulating module 73 comprises a controller, by way of example a proportional-integrative, proportional-integrative-derivative, hysteretic or fuzzy controller, configured to generate at least a reference control value COMM on the basis of the reference value of the produced braking torque Tbrake determined by the speed regulating module 72. The first module for generating electric control signals 77A, consequently also the first embedded control unit 70, is configured to generate and send the second electric control signals to said first bidirectional electric power converter device 23. In particular, this first module for generating electric control signals 77A generates and sends the second electric control signals to the controllable electronic power devices of the first bidirectional electric power converter device 23 on the basis of at least the reference control value COMM generated by the torque regulating module 73, so that said first bidirectional electric power converter device 23 controls the operation of said first electric motor 22, i.e. so that the first electric motor 22 applies a braking mechanical power on the moving device by applying a braking torque of appropriate intensity, to brake the lowering of the drilling string 12 in a controlled manner. Since the reference control value COMM, on the basis of which the first embedded control unit 70 sends the second electric control signals to the first bidirectional electric power converter device 23, is determined starting from the desired value of the controlled lowering speed Vd, it follows that said applied braking torque, and therefore said applied braking mechanical power, has an intensity such that the drilling string 12 carries out the lowering at a speed equal to the controlled lowering speed Vd. Since the desired value of the controlled lowering speed Vd is given through the first electric control signal, the first embedded control unit 70 is configured to generate and send the second electric control signals to said first bidirectional electric power converter device 23 on the basis of this first electric control signal. By sending the second electric control signals, the first embedded control unit 70 is electrically associated with this first bidirectional electric power converter device 23. On the basis of these second electric control signals sent by the first module for generating electric control signals 77A, the first bidirectional electric power converter device 23 controls at least one electric parameter of the first electric motor 22 so as to ensure the control of the lowering speed of the drilling string 12 inside the hole along the entire lowering stroke in the hole of this drilling string 12. During the braking of the drilling string 12 performed by the first electric motor 22, the first bidirectional electric power converter device 23 converts the produced electric power Pmot into converted electric power, indicated with "Pregen", and feeds it into the link 24. By means of the electric power limiting module 75, this converted electric power "Pregen" is always limited to a value not greater than the maximum electric power usable Pmax by said electric power use unit 25. In order to be able to use the fuel of the combustion engine in a more efficient way than in the known drilling machines, at least part of the converted electric power Pregen must be able to be transferred into the first electric energy storage system 40 as stored electric power Pstored in order to reuse it later. In other words, during a lowering of the drilling string at least part of the converted electric power Pregen must be able to be directed towards the first electric energy storage system 40 so that the electric power Pstored allows the first electric energy storage system 40 to store, in the at least one first storage unit 42, electric energy that can be reused later. To ensure, along the entire lowering stroke, the desired value of the controlled lowering speed of the drilling string 12 without having any instability in the operation of the moving device 21, it is essential to maintain the value of the voltage to which the link 24 is subjected within a predetermined range comprised between a minimum value and a maximum value of the voltage to which the link 24 is subjected. For this purpose, the link 24 is provided with at least one capacitor 26 arranged in parallel with the link 24 itself in order to limit the voltage oscillations of the link 24. To reduce the necessary dimensions for this at least one capacitor 26 and to maintain the voltage to which the link 24 is subjected within the predetermined range during the lowering of the drilling string 12 at a controlled speed, it is essential to control the instantaneous value of the electric power stored Pstored in said first electric energy storage system 40 on the basis of the converted electric power Pregen. This control of the instantaneous value of the stored electric power Pstored on the basis of the converted electric power Pregen is carried out by means of the second embedded control unit 80 associated with the second bidirectional electric power converter 41. The first link voltage regulating module is configured to determine the instantaneous value of the voltage of the link Vlink, imposed by the converted electric power Pregen, and to compare this value representative of the instantaneous voltage of the link Vlink with a first reference value of the voltage of the link Vlinkref1 and to generate a first control value of the voltage of the link on the basis of this comparison. The first current limiting module is configured to measure the value, imposed by the converted electric power Pregen, of the current that flows in each phase of said second bidirectional electric power converter device 41 and it is further configured to limit this value of the current that flows in each phase to a value not greater than a maximum permissible value of the phase current. By means of this first current limiting module, the second embedded control unit 80 is therefore configured to regulate the current flowing in the first storage unit 42. The second module for generating electric control signals is configured to generate and send third electric control signals to the controllable electronic power devices of the second bidirectional electric power converter device 41 based on at least one parameter among the first control value of the voltage of the link and the maximum permissible value of the phase current so as to control the instantaneous value of the stored electric power Pstored. Since both the instantaneous value of the voltage of the link Vlink and the value of the current that flows in each phase of said second bidirectional electric power converter device 41 depend on the converted electric power Pregen, the second module for generating electric control signals is configured to generate and send the third electric control signals based on the converted electric power Pregen. It follows that the second embedded control unit 80 controls the instantaneous value of the stored electric power Pstored on the basis of the converted electric power Pregen. It will therefore be understood that the real-time distributed control system 60 is arranged to control the moving device 21 during a lowering stroke of the drilling string 12 at a controlled speed precisely by means of the second electric control signals and the third electric control signals. By sending the third electric control signals, the second embedded control unit 80 is electrically associated with this second bidirectional electric power converter 41. The first thermal management module is configured to determine the instantaneous value of at least one temperature of the first storage unit 42 and to compare this instantaneous value with a maximum allowed value of the temperature. This first thermal management module is further configured to limit the maximum permissible value of the phase current and/or the value of the current that flows in each phase and/or the instantaneous value of the stored electric power Pstored on the basis of this comparison. This first thermal management module is further configured to balance the current flowing inside the first storage unit 42, that is the current flowing inside the multiplicity of supercapacitors or inside the multiplicity of secondary batteries. In particular, to obtain this balancing, the first thermal management module regulates the current flowing in each supercapacitor or flowing in each secondary battery on the basis of this instantaneous value of at least one temperature of the first storage unit 42. Advantageously it is further possible to configure this first thermal management module so as to determine the instantaneous value of the temperature of each supercapacitor or of each secondary battery. In this way, this first thermal management module can regulate the current flowing in each supercapacitor or flowing in each secondary battery on the basis of the instantaneous value of the temperature of the corresponding supercapacitor or of the corresponding secondary battery.

The third embedded control unit 90 is configured to send fourth electric control signals to the controllable electronic power devices of the third electric power converter device 53 so that the prime motor configured to generate electric power 50 sends, through the electric energy transmission network 24, electric power to the first bidirectional electric power converter device 23 and thus to the first electric motor 22 during at least one lifting stroke of the drilling string 12 towards ground level 62. This first electric motor 22 is configured to, in a first operating mode, actuate the moving device 21 so as to lift the drilling string 12, by means of the flexible tensile element 17. In said first operating mode, the first electric motor 22 converts said electric power sent by the prime motor configured to generate electric power 50 into mechanical driving power and applies said mechanical driving power to the moving device 21 to lift the drilling string 12 and perform a lifting stroke. By sending the fourth electric control signals, the third embedded control unit 90 is electrically associated with this third electric power converter device 53.

Differently from the known drilling machines which use a hydraulic motor and an overcenter valve to move the moving device of the drilling string and control the lowering speed of the drilling string inside the hole, the drilling machine 1 makes it possible to recover the gravitational potential energy possessed by the drilling string 12 at the beginning of a lowering stroke into the hole at a controlled speed and therefore makes it possible to considerably increase the overall energy efficiency with respect to the known drilling machines. In fact, this recovered gravitational potential energy can be used later in place of the chemical energy of the fuel of the combustion engine. For example, at least part of the electric energy stored in the at least one first storage unit 42 can be reused by sending it, via the electric energy transmission network 24, to the first electric motor 22 to lift the drilling string 12 and perform a lifting stroke. Being able to reduce fuel consumption allows reducing machine downtimes thanks to a lower frequency of refueling operations, and consequently allows increasing the productivity of the drilling machine 1 with respect to the known drilling machines. To this end, the present invention teaches to use the second bidirectional electric power converter device 41 which is able to make the electric power flow both from the link 24 towards the first storage unit 42 and, vice versa, from the first storage unit 42 towards the link 24. In a similar way, the present invention teaches to use the first bidirectional electric power converter device 23 which is able to make the electric power flow both from the first electric motor 22 towards the link 24 and, vice versa, from the link 24 towards the first electric motor 22.

During a lifting stroke towards ground level of the drilling string 12 inside the hole the second embedded control unit 80 is configured to send the third electric control signals to the second bidirectional electric power converter device 41 so that the first electric energy storage system 40 sends electric power to the first bidirectional electric power converter device 23 and thus to the first electric motor 22 by means of the link 24. This first electric motor 22 is configured to, in a first operating mode, actuate the moving device 21 so as to lift the drilling string 12, by means of the flexible tensile element 17. In said first operating mode, the first electric motor 22 converts said electric power sent by the first electric energy storage system 40 into mechanical driving power and applies said mechanical driving power to the moving device 21 to lift the drilling string 12 and perform a lifting stroke. In this way the second bidirectional electric power converter device 41 allows the energy previously recovered and stored in the first storage unit 42 to be used to operate the first electric motor 22 by means of the first bidirectional electric power converter device 23 during a lifting stroke of the drilling string 12 towards ground level. During this lifting stroke of the drilling string 12 the third embedded control unit 90 is configured to send the fourth electric control signals to the third electric power converter device 53 in order to send electric power to the first bidirectional electric power converter device 23 and thus to the first electric motor 22 by means of the link 24. In particular, this third electric power converter device 53 could be of the unidirectional type, i.e. able to make the electric power flow only from the second electric motor 52 towards the link 24, or it could be of the bidirectional type, i.e. able to make the electric power flow both from the second electric motor 52 towards the link 24 and from the link 24 towards the second electric motor 52. In this way, the third electric power converter device 53 allows the chemical energy of the combustion engine 51 to be used during the lifting stroke of the drilling string 12 towards ground level. In particular, the chemical energy of the fuel is transformed into mechanical energy by the combustion engine 51 and this mechanical energy is transformed into electric energy by the second electric motor 52 mechanically connected to this combustion engine 51. By sending the third electric control signals and the fourth electric control signals, the first electric energy storage system 40 and the prime motor configured to generate electric power 50 send electric power to the first electric motor 22 during a lifting stroke of the drilling string 12 thus reducing the fuel consumption necessary to perform the lifting stroke itself. It will therefore be understood that the real-time distributed control system 60 is arranged to control the moving device 21 during a lifting stroke of the drilling string 12 by means of the second electric control signals, the third electric control signals and the fourth electric control signals. Since in the drilling machine 1, to operate the first electric motor 22 during the lifting of the drilling string 12 it is possible to use the energy recovered and stored in the first storage unit 42 in addition to the chemical energy of the fuel, it is possible to reduce fuel consumption compared to the known drilling machines. In addition, since no hydraulic components such as pumps, hydraulic motors, distributors and overcenter valves are used, but only electric components are used in the drilling machine 1 of the present invention to carry out the movement of the drilling string 12, i.e. to perform the lifting during raising and/or the braking during lowering of such drilling string 12, it is possible to further reduce fuel consumption compared to conventional drilling machines thanks to the higher typical efficiency of electric components compared to hydraulic ones. Furthermore, the absence of an overcenter valve makes it possible to eliminate the fuel consumption necessary for the creation of pilot pressure.

The second bidirectional electric power converter device 41 can be of the buck type, i.e. during the lowering of the drilling string 12 at a controlled speed the voltage of the first storage unit 42 always remains not greater than the voltage of the link 24, or it can be of the buck-boost type, i.e. during the lowering of the drilling string 12 at a controlled speed the voltage of the first storage unit 42 can be either less than, equal to or greater than the voltage of the link 24. In particular, the use of the second bidirectional electric power converter device 41 of the buck type makes it possible to maximise the energy efficiency of the drilling machine 1, while the use of the second bidirectional electric power converter device 41 of the buck-boost type makes it possible to maximise the drilling depth and therefore in both cases the productivity of the drilling machine 1. By using the first electric motor 22 mechanically connected to the moving device 21 it is possible to recover the potential energy, initially possessed by the drilling string 12, with a high efficiency of the energy conversion, higher than using a hydraulic motor. In fact the use of the first electric motor 22 makes it possible to exploit the typical high efficiency of electric motors also for the recovery of the gravitational potential energy and this efficiency is certainly higher than the efficiency which could be obtained by using a hypothetical hydraulic motor acting as a pump during the lowering phase of the drilling string 12. In order to be able to totally convert into electric power the maximum braking power exerted by the moving device 21, by means of the flexible tensile element 17, onto the drilling string 12 in order to increase energy efficiency during the recovery of the gravitational potential energy, the first embedded control unit 70 is equipped with the electric power limiting module 75 configured to limit the electric power produced Pmot by said first electric motor 22 to a value not greater than the maximum electric power usable by said electric power use unit. To this end, the electric power limiting module 75 is advantageously configured to receive at least one signal representative of the value of the maximum electric power usable Pmax by said electric power use unit 25, for example this value can be set by means of a control panel electrically associated with the first embedded control unit 70, or it can be set by means of the HMI 9. According to further alternatives, the signal representative of the value of the maximum usable electric power Pmax can be sent to the first embedded control unit 70, by means of communication data transferred by the communication system 92, by the second embedded control unit 80 or by the third embedded control unit 90 or by the central control unit 91. For example, if the signal representative of the value of the maximum usable electric power Pmax was sent to the first embedded control unit 70 by the second embedded control unit 80, the second embedded control unit 80 could advantageously comprise a first module for determining the stored electric power configured to determine the instantaneous value of the stored electric power Pstored and/or to determine a maximum permissible value of the stored electric power Pstored and further configured to send these determined values to the first embedded control unit 70, by means of the communication system 92. In particular, this first module for determining the stored electric power can be advantageously configured to send, to the first embedded control unit 70, a maximum permissible value of the stored electric power Pstored which is determined on the basis of the instantaneous value of at least one temperature of the first storage unit 42.

In this case, the embedded control unit 70 would receive the signal representative of the value of the maximum electric power usable Pmax by the electric power use unit 25 as the instantaneous value of the stored electric power Pstored and/or as the maximum permissible value of the stored electric power Pstored, both determined by the second embedded control unit 80. By means of the value representative of the maximum usable electric power Pmax, it is further possible to limit the voltage oscillations of the link 24 since the converted electric power Pregen is correlated to the maximum usable electric power Pmax. In particular, the electric power limiting module 75 can be configured to receive at least two signals representative of the value of the maximum usable electric power, for example a first value representative of the maximum electric power usable Pmax by said electric power use unit 25 in continuous operating conditions (by way of example only in duty type S1, or S6, or S7, or S8, or S9, or S10 according to IEC standards of a known type) and a second value representative of the maximum electric power usable Pmax by said electric power use unit 25 in intermittent operating conditions (by way of example only in duty type S2, or S3, or S4, or S5 according to IEC standards of a known type). In order to be able to limit the electric power produced Pmot by said first electric motor 22 to a value not greater than the maximum usable electric power Pmax, the first bidirectional electric power converter device 23 comprises controllable electronic power devices. In fact, by using controllable electronic power devices, it is possible to guarantee the control of the electric power produced Pmot by the first electric motor 22, thus ensuring the control of the lowering speed of the drilling string 12, and consequently it is possible to limit the electric power produced Pmot by said first electric motor 22 to a value not greater than the maximum electric power usable Pmax by the electric power use unit 25. In particular, in the first embodiment of the present invention, it is advantageous to use controllable electronic power devices with forced commutation, for example IGBTs, since in this way it is possible to commute the controllable electronic power devices independently of the rotational speed of the first electric motor 22, making it possible to always guarantee control of the lowering speed of the drilling string 12 even at low rotational speeds of said first electric motor 22. In addition, by using controllable electronic power devices with forced commutation, it is possible to minimise the harmonic content of the current with the consequent advantage of further improving the efficiency of the drilling machine 1 while reducing the dimensions of the electric and electronic components. In order for the maximum braking power, which is exerted on the drilling string 12 by the moving device 21 by means of the flexible tensile element 17 and which is totally converted into produced electric power by the first electric motor 22, to be able to reach a value compatible with the high maximum braking power required for the moving device 21, the electric power use unit 25 is provided with the first storage unit 42 having high power. In the case wherein this high-power first storage unit 42 comprises a first unit of supercapacitors, thanks to the high power density typical of supercapacitors, i.e. thanks to the high power for a given size, it is possible to ensure the high maximum braking power required while maintaining reduced overall dimensions. In the case wherein this high-power first storage unit 42 comprises a first unit of secondary batteries, i.e. rechargeable batteries, thanks to the low cost typical of the batteries it is possible to ensure the high maximum braking power required while maintaining low costs. In an advantageous way it is possible to use secondary batteries arranged to make flowing, during a lowering stroke of the drilling string 12 at a controlled speed, a current having a value greater than the value of the current which can flow in such secondary batteries under continuous operating conditions, for example which can flow in duty type S1 according to IEC standards of a known type. In this advantageous manner, it is possible to ensure the high maximum braking power required while maintaining low costs and also minimising the bulk of these secondary batteries. Therefore, thanks to the use of a first electric energy storage system 40 having high power and thanks to the adoption of the electric power limiting module 75, the high maximum braking power required for the moving device 21 is thus available to the operator and the same can control the intensity of the applied braking mechanical power by acting by means of the control group 7. Since the electric power use unit 25 is arranged to receive the electric power produced Pmot by the first electric motor 22, it is possible to maintain the voltage of the link 24 within a predetermined range comprised between a minimum value and a maximum value while also maintaining a reduced size of the capacitor 26 of the link 24. Therefore being able to maintain the voltage of the link 24 within a predetermined range makes it possible to avoid any operation instability. In order for the electric power use unit 25 to be able to receive the electric power produced Pmot by the first electric motor 22 and also to maximise the efficiency of the drilling machine 1, the second bidirectional electric power converter device 41 is provided preferably of the multi-phase type. In fact, by using a multi-phase configuration, it is possible to decrease, with respect to a single-phase configuration, the value of the current that flows in each phase of the second bidirectional electric power converter device 41 with the advantageous consequence of being able to reduce power losses due to the Joule effect and thus guarantee high efficiency of the drilling machine 1 even at maximum braking power. To improve the control of the lowering speed of the drilling string 12, the control program of the first embedded control unit 70 comprises the instantaneous position and speed derivation module 78. In a first case, this instantaneous position and speed derivation module 78 comprises a group of calculation instructions which implements a calculation method configured to determine, also at very low or zero instantaneous angular speed of the rotor of the first electric motor 22, the instantaneous angular position and the instantaneous angular speed of the rotor of the first electric motor 22 on the basis of an electric signal sent by a sensor connected to this rotor, for example an encoder or a resolver. In a second case, the instantaneous position and speed derivation module 78 comprises a group of calculation instructions which implements a calculation method configured to determine, also at very low or zero instantaneous angular speed of the rotor of the first electric motor 22, the instantaneous angular position and the instantaneous angular speed of the rotor of the first electric motor 22 on the basis of an estimator or an observer of the instantaneous angular position of the rotor itself, for example based on the injection of high-frequency signals, or based on the presence of harmonics associated with the presence of slots in the rotor, or based on a mathematical model of the first electric motor 22 or, more generally, by means of any calculation method configured to determine the instantaneous angular position and instantaneous angular speed of the rotor, even at a zero instantaneous angular speed of the rotor. By using an estimator or an observer of the instantaneous angular position of the rotor it is advantageously possible to avoid using a sensor connected to this rotor, with consequent cost savings. It will therefore be understood that, in both cases, the first electric motor 22 can apply, on the moving device 21, the maximum braking torque also at very low angular speed, even at an angular speed equal to zero. On the one hand, this makes it possible to improve the control of the lowering speed of the drilling string 12 also at very low speeds and, on the other hand, makes it possible for the first electric motor 22 to brake the moving device 21 to keep the drilling string 12 suspended by means of the flexible tensile element 17, i.e. to hold the weight of said drilling string 12 at a zero instantaneous lowering speed Vinst, without necessarily having to operate the mechanical parking brake. Since the high maximum braking power required for the moving device 21 is available to the operator, it is therefore advantageously possible to avoid using a dynamic mechanical brake and it is possible to use only a parking mechanical brake. In this way an increase in the energy efficiency of the drilling machine 1 is obtained, since it is not necessary to adopt a dissipative mechanical braking exerted by a hypothetical dynamic mechanical brake. Nevertheless, the drilling machine 1 ensures safety against a possible malfunction of the first embedded control unit 70 and/or the first bidirectional electric power converter device 23 and/or the first electric motor 22 and/or the electric energy transmission network 24 and/or the first electric energy storage system 40 and/or the second embedded control unit 80 and/or the prime motor 50 and/or the third embedded control unit and/or the central control unit 91. In fact the mechanical parking brake can be advantageously configured to be automatically engaged, completely stopping the movement of this moving device 21 and holding the drilling string 12 by means of the flexible tensile element 17, in the event that emergency braking must be applied, for example in the event of a malfunction or if the operator activates an emergency stop function. To this end, it is possible to electrically associate this mechanical parking brake with the first embedded control unit 70, so that this mechanical parking brake can be automatically engaged based on the presence, or alternatively based on the absence, of an electric control signal sent by this first embedded control unit 70. Alternatively, it is possible to electrically associate this mechanical parking brake with the central control unit 91, so that this mechanical parking brake can be automatically engaged based on the presence, or alternatively based on the absence, of an electric control signal sent by this central control unit 91. The use of the real-time distributed control system 60 for the drilling machine is advantageous in order to improve the control of the lowering speed of the drilling string 12 inside the hole. In particular, the fact that the control system is of the real-time type allows performing the control of the lowering speed of the drilling string 12 within predefined and certain calculation time periods, making this control insensitive to the response delays which are present in the drilling machines of the known type using a hydraulic system for controlling the lowering speed of the drilling string and which are caused by the compressibility of the hydraulic oil, the elasticity of the pipes and the mechanical response delays of the valves and hydraulic distributors. The real-time control system 60 also makes it possible to increase the safety of the controlled-speed lowering phase of the drilling string 12, therefore making it possible to increase the safety of the entire drilling machine 1, since the communication data having a critical function for the safety of the drilling machine 1 can be transferred by the communication system 92 and processed by the units of the control system 60 within predefined calculation time periods, rendering this real-time control system 60 capable of reacting to safety-critical conditions by adopting corrective actions in similarly predefined and certain time periods. In addition, the fact that the control system 60 is of the distributed type is advantageous for the drilling machine 1 since it makes it possible to increase its productivity. In fact, thanks to the adoption of the distributed architecture it is possible to use embedded control units 70, 80, 90, i.e. control units which are integrated, i.e. "special-purpose", and which are optimised specifically for the control of the moving device 21, in addition to the use of the central control unit 91 which is "general-purpose". In particular, it is to be understood that each embedded control unit 70, 80, 90 is specifically designed to control a specific component of the drilling machine 1. Specifically, the first embedded control unit 70 is designed to control the first electric motor 22 by means of the first bidirectional electric power converter device 23, the second embedded control unit 80 is designed to control the first storage unit 42 by means of the second bidirectional electric power converter device 41 and the third embedded control unit 90 is designed to control the second electric motor 52 by means of the third electric power converter device 53. By means of these embedded control units 70, 80, 90 it is therefore possible to optimise the operation of the real-time distributed control system 60 in order to improve the control of the lowering speed of the drilling string 12 inside the hole, to increase the energy efficiency of the drilling machine 1 and to ensure the stability in the operation of the moving device 21. By means of these embedded control units 70, 80, 90 it is also possible, thanks to the integration and optimisation of these embedded control units, to use safety functions which are optimised for controlling a specific component of the drilling machine 1. It must therefore be understood that the central control unit 91 can be advantageously configured to superintend general safety functions of the drilling machine 1, such as for example the verification of compatibility of the first electric control signal, while each embedded control unit 70, 80, 90 can be advantageously configured to superintend specific safety functions for a specific component of the drilling machine 1. In particular, the first embedded control unit 70 can be configured to superintend safety functions related to the correct operation of the first electric motor 22 and of the first bidirectional electric power converter device 23, the second embedded control unit 80 can be configured to superintend safety functions related to the correct operation of the second bidirectional electric power converter device 41 and of the first storage unit 42, the third embedded control unit 90 can be configured to superintend safety functions related to the correct operation of the third electric power converter device 53 and of the second electric motor 52. Merely by way of example, the second embedded control unit 80 can be configured to disconnect the first storage system 40 from the electric energy transmission network 24 following a possible malfunction of the second bidirectional electric power converter device 41 and/or of the first storage unit 42 and to send, to the first embedded control unit 70 or to the central control unit 91, communication data representative of this malfunction situation, so that the mechanical parking brake can be automatically engaged. Following a malfunction of the first storage system 40, for example because the instantaneous value of at least one temperature of the first storage unit 42 has exceeded a maximum allowed value, the second embedded control unit 80 could determine a reduced value, as a limit equal to zero, of the maximum permissible value of the stored electric power Pstored and send, by means of the communication system 92, to the first embedded control unit 70 or to the central control unit 91 this reduced value together with communication data representative of the malfunction situation. By means of the communication system 92, merely by way of example interbus, profibus, profinet, EtherCAT, devicenet, CAN-bus, modbus or any field bus configured to transfer at least part of the communication data in real-time, it is possible to guarantee the correct exchange of the communication data both between the embedded control units 70, 80, 90 and between each embedded control unit 70, 80, 90 and the central control unit 91. By using the central control unit 91 it is advantageously possible to guarantee the functional safety of the drilling machine 1. In particular, by means of the central control unit 91 it is possible to guarantee the correct sequence of the operations associated with the real-time distributed control system 60 and, more generally, the correct sequence of all the operations associated with the drilling machine 1. In addition, the central control unit 91 is configured to perform, at predetermined time intervals, a verification of the correct operation of this real-time distributed control system 60 and is configured to send, based on this verification, electric control signals to the embedded control units 70, 80, 90 and to the mechanical parking brake. In particular, if this verification identifies the malfunction of any embedded control unit 70, 80, 90 and/or if the operator activates an emergency stop function, this central control unit 91 is configured to send to the embedded control units 70, 80, 90 and to the mechanical parking brake the electric control signals representative of the request to perform an emergency braking of the moving device 21. In a completely equivalent manner, the central control unit 91 is configured to send, on the basis of the verification of the correct operation of the real-time distributed control system 60, electric control signals only to the embedded control units 70, 80, 90 and the first embedded control unit 70 is configured to send an electric control signal to this mechanical parking brake on the basis of the electric control signals sent by the central control unit 91. The central control unit 91 is also advantageously configured to verify the compatibility of the first electric control signal, sent by the control group 7, with the operating status of the drilling machine 1. This operating status can be determined automatically by the central control unit 91 or it can be determined by the central control unit 91 based on input parameters entered by the operator of the drilling machine by means of the HMI. In particular, by means of the verification of compatibility of the first electric control signal, this central control unit 91 can prevent the lowering of the drilling string 12 during prescribed operating statuses of the drilling machine 1, by way of example during assembly/disassembly operations or maintenance operations of the drilling machine 1. In addition, by means of the verification of compatibility of the first electric control signal, the central control unit 91 can limit, on the basis of the operating status of the drilling machine 1, the desired value of the controlled lowering speed Vd. For example, the central control unit 91 can reduce this desired value of the controlled lowering speed Vd during assembly/disassembly stage or maintenance stage of the drilling machine 1. If the central control unit 91 reduces the desired value of the controlled lowering speed Vd, the control program of the first embedded control unit 70 processes only this reduced value of the desired lowering speed Vd and not the value of the desired lowering speed Vd represented by the first electric control signal. The speed limiting module 71 can advantageously vary the maximum value of the controlled lowering speed Vmax of the drilling string 12 with the varying of the position of the drilling tool Pos; for example this maximum value of the controlled lowering speed Vmax can be lower when the drilling tool 16 is outside the hole 61 and it can be greater when the drilling tool 16 is inside the hole 61. This different maximum value of the controlled lowering speed based on the position of the drilling tool makes it possible to increase the safety of the drilling machine 1 with respect to the known types of drilling machines. In addition, since the maximum value of the controlled lowering speed can be greater when the drilling tool 16 is inside the hole, it is possible to guarantee the high productivity of the drilling machine 1. The speed limiting module 71 can advantageously vary the maximum value of the controlled lowering speed Vmax of the drilling string also with the varying of the instantaneous weight acting on the flexible tensile element Weight; for example, this maximum value Vmax can be lower when the drilling string 12 used is heavier and it can be higher when the drilling string 12 used is lighter. As a further example, this maximum value Vmax can be lower when the entire weight of the drilling string 12 acts on the flexible tensile element 17 and it can be greater when at least part of the weight of the drilling string 12 has already been transferred onto the drilling head 11. In addition, based on the instantaneous weight acting on the flexible tensile element Weight, it is advantageously possible to vary the maximum value of the controlled lowering speed Vmax with the installation of a new drilling string 12 on the drilling machine 1, on the basis of the weight of this new drilling string. In this way it is possible to maximise the productivity of the drilling machine 1 since the use of a drilling string 12 which is lighter than the maximum weight allowed for a given size of the drilling machine 1 makes it possible to increase the maximum value of the controlled lowering speed and therefore to reduce the time that is not usefully employed in drilling the hole. The speed limiting module 71 takes into account, in determining the maximum value of the controlled lowering speed Vmax of the drilling string 12, also the maximum permissible rotational speed Nmax1 of the moving device 21 or of the gearbox 34 and the maximum permissible rotational speed Nmax2 of the first electric motor 22. In this way it is possible to avoid exceeding a maximum rotational speed of the moving device 21 or of the gearbox 34 and of the first electric motor 22, thus making it possible to increase the safety of the drilling machine 1 against any mechanical damage. The speed limiting module 71 can advantageously vary the maximum value of the controlled lowering speed Vmax of the drilling string 12 also with the varying of the type of drilling technique used; for example this maximum value of the controlled lowering speed Vmax can be lower when using a drilling technique that involves the use of a continuous flight auger mechanically connected to the drilling head, such as the "CFA" or the "CAP", in order to avoid the phenomenon of the screwing of the continuous flight auger without removing soil. The maximum value of the controlled lowering speed Vmax can be greater when using a drilling technique that involves the use of a drilling tool mechanically connected to tubular telescopic elements, such as the "LDP", in order to minimise the time that is not usefully employed in drilling the hole. In addition, depending on the type of drilling technique used, the maximum value of the controlled lowering speed Vmax can be advantageously greater when "dry drilling" is carried out, i.e. in the absence of a fluid sustaining the hole, as dry drilling does not involve a risk of erosion of the walls of the hole, while the maximum value of the controlled lowering speed can be lower when "fluid drilling" is carried out, to avoid erosion of the walls of the hole due to an excessively turbulent movement of this fluid when the drilling tool passes through. The speed limiting module 71 can vary the maximum value of the controlled lowering speed Vmax also with the varying of the type of drilling tool Tool used, for example with the varying of the geometry and category of the drilling tool 16. Advantageously, this maximum value of the controlled lowering speed Vmax can be greater with the increase of the pitch of the flight of the continuous flight auger and it can be smaller with the decrease of the pitch of the flight of the continuous flight auger, in order to avoid the phenomenon of the screwing of the continuous flight auger without removing soil. Furthermore, it is possible to decrease the maximum value of the controlled lowering speed Vmax if the geometry of the drilling tool 16 is particularly critical with respect to the phenomenon of erosion of the walls of the hole due to the turbulent movement of the fluid sustaining the hole, for example in the case wherein a particularly tall drilling tool 16 is used. In determining the maximum value of the controlled lowering speed Vmax of the drilling string 12, the speed limiting module 71 also takes into account the energy efficiency of the first electric motor 22 so as to maximise the energy efficiency of the first electric motor 22 during at least one lowering stroke of the drilling string 12 at a controlled speed. In determining the maximum value of the controlled lowering speed Vmax, the speed limiting module 71 also takes into account the maximum electric power usable Pmax by the electric power use unit 25 so that the electric power produced Pmot by said first electric motor 22 is limited to a value not greater than the maximum electric power usable Pmax by said electric power use unit 25. As already explained, by means of the actuation of the control device 8 or of the HMI 9, the operator can give the desired value of the controlled lowering speed Vd. In particular, it is advantageous to preset an optimum value of the controlled lowering speed only once at the beginning of the hole drilling operations. For example, this optimum value can be preset by the operator by means of the HMI 9 on the basis of the drilling tool used or on the basis of the drilling technique used. Subsequently, the operator can actuate the control device 8 to give the desired value of the controlled lowering speed Vd as a percentage, or in any case generally as a fraction, of the preset optimum value. For example, if the operator actuates the control device 8 by bringing this control device 8 to the full scale, the desired value of the controlled lowering speed Vd will be equal to the optimum value preset by means of the HMI 9. If the operator actuates the control device 8 by bringing this control device 8 to 50% of its full scale, the desired value of the controlled lowering speed Vd will be equal to half the optimum value preset by means of the HMI 9, i.e. proportionally to the extent of the actuation of the control device 8. Obviously it is possible to vary an adjustment of the control device 8 so that the desired value of the controlled lowering speed Vd does not proportionally correspond to the extent of the actuation of the control device 8 but it corresponds according to a non-proportional law. The control group 7 can be associated with the drilling machine 1 through a mechanical connection with the supporting structure 3 or it can be associated with the drilling machine 1 only by means of a wired electrical connection or a wireless connection with the real-time distributed control system 60. The acceleration and deceleration limiting module 79 can vary the maximum value of the lowering acceleration or lowering deceleration Amax of the drilling tool 16 with the varying of the position of the drilling tool Pos; for example the maximum value of the acceleration can be lower when the drilling tool 16 is outside the hole and can be greater when the drilling tool 16 is inside the hole. This different maximum value of the acceleration based on the position of the drilling tool Pos makes it possible to increase the safety of the drilling machine with respect to the known drilling machines. In addition, since the maximum value of the acceleration can be greater when the drilling tool 16 is inside the hole, it is possible to guarantee the high productivity of the drilling machine 1. The acceleration and deceleration limiting module 79 can vary the maximum value of the lowering acceleration or lowering deceleration Amax of the drilling tool 16 also with the varying of the instantaneous weight acting on the flexible tensile element Weight; for example the maximum value of the acceleration can be greater when the instantaneous weight acting on the flexible tensile element 17 is smaller, while it can be smaller when the instantaneous weight acting on the flexible tensile element 17 is greater. Conversely, the maximum value of the deceleration can be lower when the instantaneous weight acting on the flexible tensile element 17 is greater, while it can be greater when the instantaneous weight acting on the flexible tensile element 17 is smaller. This different maximum value of the acceleration or deceleration allows the drilling machine 1 to reduce the dynamic overloads imposed on the flexible tensile element 17, thus also affecting the moving device 21, with respect to the known types of drilling machines. The acceleration and deceleration limiting module 79 can vary the maximum value of the lowering acceleration or lowering deceleration Amax of the drilling tool 16 also with the varying of the type of drilling technique used; for example the maximum value of the acceleration can be greater when the drilling technique used involves the use of a drilling tool mechanically connected to tubular telescopic elements, such as the "LDP", in order to minimise the time that is not usefully employed in drilling the hole, while it can be smaller when using the drilling technique that involves the use of a continuous flight auger mechanically connected to the drilling head, such as the "CFA" or the "CAP", since a high acceleration value would indicate the presence of the phenomenon of the screwing of the continuous flight auger without removing soil. The acceleration and deceleration limiting module 79 can advantageously vary the maximum value of the lowering acceleration or lowering deceleration Amax of the drilling tool 16 also with the varying of the type of drilling tool Tool used; for example, the maximum value of the acceleration can be greater if a drill is used, while it can be smaller if a bucket is used, since the bucket may be more prone to causing erosion of the walls of the hole following sudden acceleration or deceleration. The drilling machine 1 can advantageously house on the supporting structure 3 at least the first electric motor 22, the first bidirectional electric power converter device 23, the first storage system 40, the first embedded control unit 70 and the second embedded control unit 80. Since this supporting structure 3 is necessarily of limited size in order to be mechanically connected to the mobile assembly 2 possibly rotating about the axis R with limited inertia forces, it is fundamental to contain the dimensions and masses of the components housed on it in order to avoid problems related to the stability of the drilling machine and in order to minimise the inertia forces deriving from the rotation of the supporting structure itself. To this end, the drilling machine 1 comprises a liquid cooling system for the first electric motor 22, for the first bidirectional electric power converter device 23, for the second bidirectional electric power converter device 41, for the first storage unit 42, for the first embedded control unit 70 and for the second embedded control unit 80. By means of the liquid cooling system, for example water and glycol, it is advantageously possible to reduce both the dimensions and the masses of such components with respect to the use of air cooling systems. Moreover, by means of this liquid cooling system, it is possible to increase the reliability of these components since it is possible to isolate them from the high quantity of dust typically present in the construction sites wherein drilling machines are used, thanks also to the adoption of an appropriate IP protection rating. If the prime motor configured to generate electric power 50 is mechanically associated with the supporting structure 3, it is advantageous to use a liquid cooling system also for the third electric power converter device 53, for the second electric motor 52 and for the third embedded control unit 90. If the prime motor configured to generate electric power 50 is not mechanically associated with the supporting structure 3 but it is only electrically connected to the electric energy transmission network 24, it is possible to use an air cooling system for the second electric motor 52 and/or for the third electric power converter device 53 and/or for the third embedded control unit 90.

In a first variant of the first embodiment, the electric power limiting module 75, hence the first embedded control unit 70, is configured to determine the instantaneous value of the electric power produced Pmot by said first electric motor 22 and/or to determine the instantaneous value of the electric power converted Pregen by said first bidirectional electric power converter device 23 and to send to the second embedded control unit 80 at least one of these determined instantaneous values, by means of the communication system 92; alternatively or in addition, the at least one of these determined instantaneous values can be sent to the central control unit 91. In the event of a malfunction of the first electric energy storage system 40, the second embedded control unit 80 could determine a reduced value, as a limit equal to zero, of the instantaneous value of the stored electric power Pstored and send to the first embedded control unit 70 or to the central control unit 91 the communication data representative of this reduced value, by means of the communication system 92. The first embedded control unit 70 or the central control unit 91 could compare this reduced value with the instantaneous value of the electric power produced Pmot or converted Pregen, both determined by the first embedded control unit 70, and, if they differ substantially from this reduced value, would identify such communication data as representative of the malfunction situation. In the first variant the module for determining the stored electric power, therefore the second embedded control unit 80, is configured to receive this instantaneous value of the electric power produced Pmot and/or this instantaneous value of the electric power converted Pregen and it is further configured to generate, based on these instantaneous values received, a control value of the stored electric power Pstored. The second module for generating electric control signals, therefore the second embedded control unit 80, is configured to generate and send the third electric control signals to the controllable electronic power devices of the second bidirectional electric power converter device 41 on the basis of at least this control value of the stored electric power Pstored so that the second bidirectional electric power converter device 41 controls the instantaneous value of the electric power stored Pstored in the first electric energy storage system 40 on the basis of at least one instantaneous value determined by the first embedded control unit 70. Since the instantaneous value of the converted electric power Pregen derives from the instantaneous value of the produced electric power Pmot and from the efficiency of the first bidirectional electric power converter device 23, the module for determining the stored electric power is therefore able to control the instantaneous value of the stored electric power Pstored on the basis of an instantaneous value representative of the electric power produced Pmot by said first electric motor 22. The first variant of the first embodiment makes it possible to reach and maintain the desired value of the controlled lowering speed Vd of the drilling tool 16 inside the hole avoiding, in an even more performing way, incurring any instability in the operation of the moving device 21 caused by excessive oscillation of the value of the voltage of the link 24. In fact it is possible to eliminate the oscillations of the voltage of the link because, instant by instant, the instantaneous value of the electric power stored Pstored in said first electric energy storage system 40 is controlled directly on the basis of the electric power produced Pmot, without having to determine the instantaneous value of the voltage of the link 24 and without having to compare this instantaneous value to a first reference value of the voltage of the link. In this way it is possible to enhance the performance of the control of the voltage of the link 24, with the consequence of reducing and, at most, eliminating the oscillations of the voltage of the link 24. In fact, it is possible to control the instantaneous value of the stored electric power Pstored directly on the basis of the instantaneous value of the produced electric power Pmot without the first link voltage regulating module having to wait, in order to be able to vary the instantaneous value of the stored electric power Pstored, the occurrence of a variation in the instantaneous value of the voltage of the link with respect to the first reference value of the voltage of the link.

In the first variant of the first embodiment, the first embedded control unit 70 further comprises an adaptive control module configured to vary the value of some characteristic parameters of the controller of the speed regulating module 72, for example the gain values of the proportional and/or integrative and/or derivative term or the value of the bandwidth of the hysteretic controller or the value of weight factors associated with the fuzzy rules of the controller. This variation of some characteristic parameters of the controller can be carried out instant by instant on the basis of the instantaneous weight Weight acting on the flexible tensile element 17 or it can be carried out instant by instant on the basis of parameters representative of the geometry of the drilling string used, for example based on the length of the kelly telescopic rods, and based on the position Pos of the drilling tool. Since this variation can be carried out instant by instant, it is advantageously possible for the adaptive control module to vary the value of some characteristic parameters of the controller several times during the same lowering stroke inside the hole. By means of this variation of some characteristic parameters of the controller, it is possible to optimise the readiness, accuracy and stability of the control of the controlled lowering speed of the drilling string both with respect to the sudden variations of the weight acting on the flexible tensile element 17, which occur when a telescopic rod transfers its weight onto the drilling head, and with respect to the unforeseeable variations of the friction acting on the drilling string 12 during the lowering at a controlled speed inside the hole.

Figure 4:
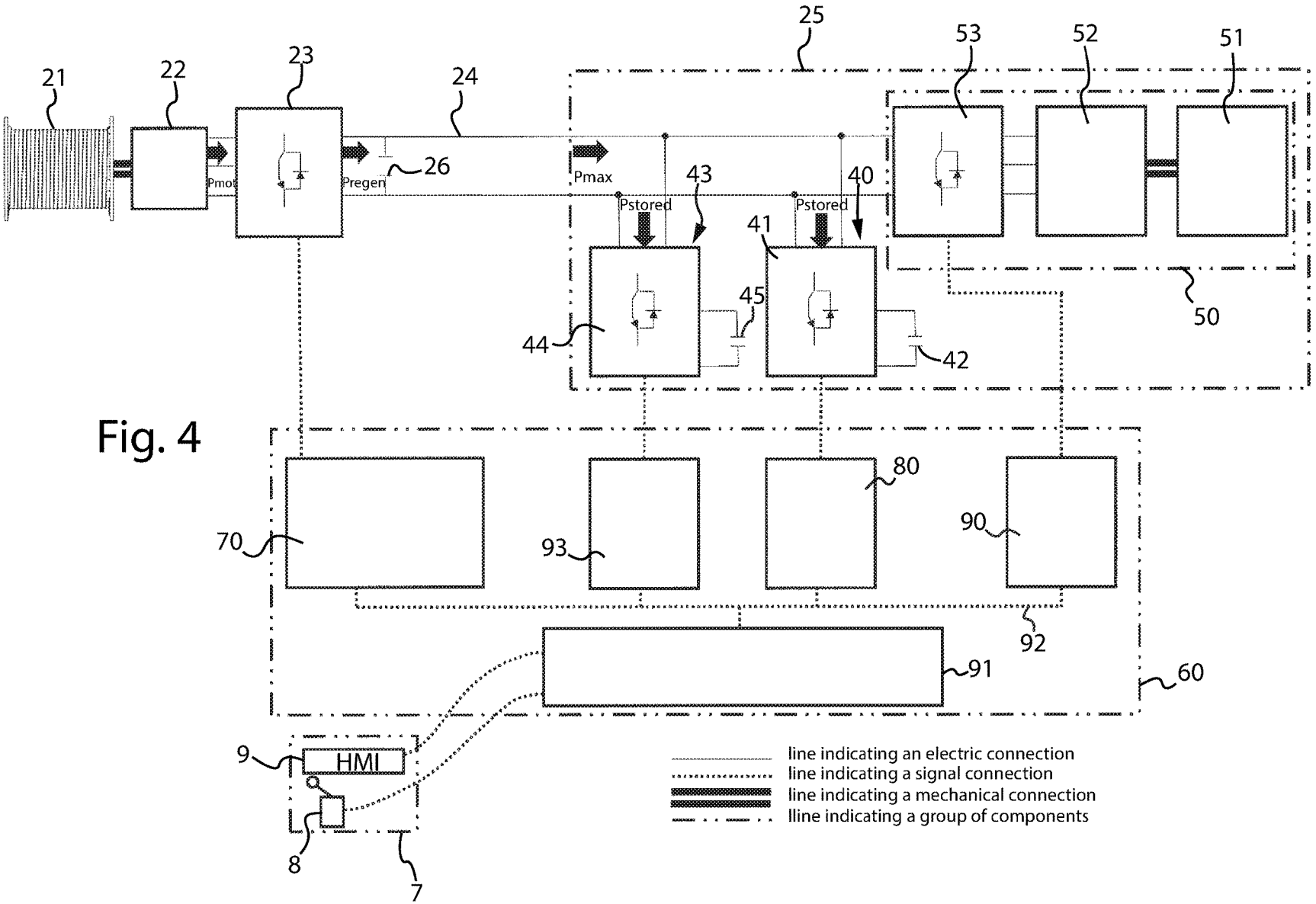
FIG. 4 is a block diagram illustrating a moving device, a first electric motor, a first bidirectional electric power converter device, an electric energy transmission network, a control system, a control group and an electric power use unit which are comprised in the drilling machine of FIG. 1 and configured according to a variant of the first embodiment of the present invention.

FIG. 4 shows a second variant of the first embodiment of the drilling machine 1. In this second variant, the electric power use unit 25 also comprises a second electric energy storage system 43. This second electric energy storage system 43 comprises at least one fourth bidirectional electric power converter device 44 comprising electronic power devices controllable by means of electric control signals, such as for example thyristors (SCR, GTO) or transistors (IGBT, FET, MOSFET, BJT), and at least one second storage unit 45. This second storage unit 45 can be a second unit of supercapacitors which comprises a multiplicity of supercapacitors, merely by way of example electric double layer capacitors, electrically connected together in series and/or in parallel or it can be a second unit of secondary batteries which comprises a multiplicity of secondary batteries, merely by way of example lithium batteries of the Li-Ion or Li—FePO4 type or pure lead batteries, electrically connected together in series and/or in parallel. It will therefore be understood that the second electric energy storage system 43 can be constituted in an identical manner to the first electric energy storage system 40, i.e. comprising the same components. Alternatively, the second electric energy storage system 43 can be constituted in a similar way to the first electric energy storage system 40, and can differ in the size of the components used, i.e. the dimensions and/or the nominal electric values of the data plate which are specified in the component datasheet (e.g. energy capacity, rated power, rated current, rated voltage). In particular in this alternative, the fourth bidirectional electric power converter device 44 could differ in size from the first bidirectional electric power converter device 41 and the second storage unit 45 could differ in size from the first storage unit 42 but both the first storage unit 42 and the second storage unit 45 would both be constituted by supercapacitors or both by secondary batteries. In a further alternative, the first electric energy storage system 40 and the second electric energy storage system 43 could differ also as regards the type of components used. In particular in this further alternative, the first storage unit 42 can be a first unit of supercapacitors while the second storage unit 45 can be a second unit of secondary batteries or vice versa. In particular, although in FIG. 4 only two electric energy storage systems are represented, i.e. the first electric energy storage system 40 and the second electric energy storage system 43, it should be understood that the second variant of the first embodiment of the drilling machine 1 can envisage using an electric power use unit 25 comprising a plurality of electric energy storage systems in a number greater than or equal to two. In the second variant of the first embodiment of the drilling machine 1, the real-time distributed control system 60 comprises, in addition to the central control unit 91, the communication system 92, the first embedded control unit 70, the second embedded control unit 80 and the third embedded control unit 90, also a fourth embedded control unit 93 associated with the fourth bidirectional electric power converter device 44. In this case the communication system 92 is arranged to transfer the communication data between the embedded control units 70, 80, 90, 93 and between each embedded control unit 70, 80, 90, 93 and the central control unit 91. The fourth embedded control unit 93, for example comprising at least one DSP and/or one microprocessor and/or one microcontroller and/or one FPGA, is advantageously made in an analogous manner to what was previously described with reference to the second embedded control unit 80. In particular, the fourth embedded control unit 93 is programmed, that is, comprises a computer control program loaded into a memory unit of the fourth embedded control unit 93. This control program comprises at least a third link voltage regulating module, a second current limiting module, a fourth module for generating electric control signals and a second thermal management module. If the value of the maximum electric power usable Pmax by the electric power use unit 25 was sent to the first embedded control unit 70 also by the fourth embedded control unit 93, by means of communication data transferred by the communication system 92, this fourth embedded control unit 93 could advantageously comprise a second module for determining the stored electric power. The operation of these modules will not be described since it is analogous to that already described for the first embodiment with reference to the second embedded control unit 80. In particular, by sending sixth electric control signals, the fourth embedded control unit 93 is electrically associated with the fourth bidirectional electric power converter device 44. It will therefore be understood that the real-time distributed control system 60 is arranged to control the moving device 21 during a lowering stroke of the drilling string 12 at controlled speed by means of the second electric control signals, the third electric control signals and the sixth electric control signals. By sending the third electric control signals, the fourth electric control signals and the sixth electric control signals, the first electric energy storage system 40, the prime motor configured to generate electric power 50 and the second electric energy storage system 43 send electric power to the first electric motor 22 during a lifting stroke of the drilling string 12. This first electric motor 22 is configured to, in a first operating mode, actuate the moving device 21 so as to lift the drilling string 12, by means of the flexible tensile element 17. In said first operating mode, the first electric motor 22 converts into mechanical driving power said electric power sent by the first electric energy storage system 40, by the prime motor configured to generate electric power 50, by the second electric energy storage system and applies said mechanical driving power to the moving device 21 to lift the drilling string 12 and perform a lifting stroke. It will therefore be understood that the real-time distributed control system 60 is arranged to control the moving device 21 during a lifting stroke of the drilling string 12 by means of the second electric control signals, the third electric control signals, the fourth electric control signals and the sixth electric control signals. The second variant of the first embodiment as described above allows further satisfying the objectives of the present invention while at the same time solving the problems present in the known types of drilling machines. In fact, the use of a plurality of electric energy storage systems makes it possible to further reduce fuel consumption with respect to the known types of drilling machines. In particular, by using a plurality of electric energy storage systems it is advantageously possible to recover a greater quantity of gravitational potential energy possessed by the drilling string 12 at the beginning of a lowering stroke into the hole at a controlled speed and therefore it is possible to further increase the overall energy efficiency of the drilling machine 1 with respect to the known types of drilling machines. Consequently, it is possible to use a drilling string having a greater weight, for example a longer drilling string 12. The use of a longer drilling string, for example a longer continuous flight auger or a greater number of tubular telescopic elements, makes it possible to further increase the drilling depths which can be reached with respect to the known types of drilling machines. Since increasing the drilling depth also increases the fuel consumption necessary for the known types of drilling machines to move the drilling string, because this movement of the drilling string covers an increasingly significant part of the working cycle with the increase in drilling depth, the drilling machine 1 according to the second variant of the first embodiment makes it possible to further reduce fuel consumption compared to the known types of drilling machines. In addition, by using a plurality of electric energy storage systems it is advantageously possible to further increase the maximum electric power usable Pmax by the electric power use unit 25 and therefore it is possible to further increase the maximum braking mechanical power applied by the first electric motor 22 to the moving device 21. By way of example, if the first electric energy storage system 40 and the second electric energy storage system 43 were present, the signal representative of the value of the maximum electric power usable Pmax by the electric power use unit 25 could represent the sum of the instantaneous value of the stored electric power Pstored or the sum of the maximum permissible value of the stored electric power Pstored determined by the respective embedded control units 80 and 93. In this way it is advantageously possible to further increase the maximum value of the controlled lowering speed Vmax of the drilling string 12 inside the hole and therefore it is possible to further increase the productivity of the drilling machine 1 with respect to the known types of drilling machines. If additional storage systems are desired on the drilling machine 1, it will be sufficient to configure again the electric power limiting module 75 by means of a signal representative of the new value of the maximum electric power usable Pmax by the electric power use unit 25. By using a plurality of electric energy storage systems it is also possible to guarantee a redundancy against a possible malfunction of an electric energy storage system and therefore it is possible to guarantee the safety of the drilling machine 1 without the mechanical parking brake having to be necessarily engaged following such a malfunction. For example, should a malfunction of the first electric energy storage system 40 occur, the drilling machine 1 according to the second variant of the first embodiment could use the second electric energy storage system 43 without having to interrupt the working cycle. In this way it is possible to further increase the productivity of the drilling machine 1. The fourth bidirectional electric power converter device 44 can be of the buck type, i.e. during the lowering of the drilling string 12 at a controlled speed the voltage of the second storage unit 45 always remains not greater than the voltage of the link 24, or it can be of the buck-boost type, i.e. during the lowering of the drilling string 12 at a controlled speed the voltage of the second storage unit 45 can be either less than, equal to or greater than the voltage of the link 24. In particular, the use of the fourth bidirectional electric power converter device 44 of the buck type makes it possible to maximise the energy efficiency of the drilling machine 1, while the use of the fourth bidirectional electric power converter device 44 of the buck-boost type makes it possible to maximise the drilling depth and therefore in both cases the productivity of the drilling machine 1. The fourth bidirectional electric power converter device 44 is advantageously of the multi-phase type in order to reduce energy losses due to the Joule effect and maximise the efficiency of the drilling machine 1. If the second electric energy storage system is constituted identically to the first electric energy storage system, the economic advantage deriving from a possible economy of scale would be obtained. If the second electric energy storage system differs from the first electric energy storage system 40 in the type of components used, an advantage is obtained in simultaneously exploiting both the limited overall dimensions typical of the supercapacitors and the low cost typical of the secondary batteries.

Figure 5:
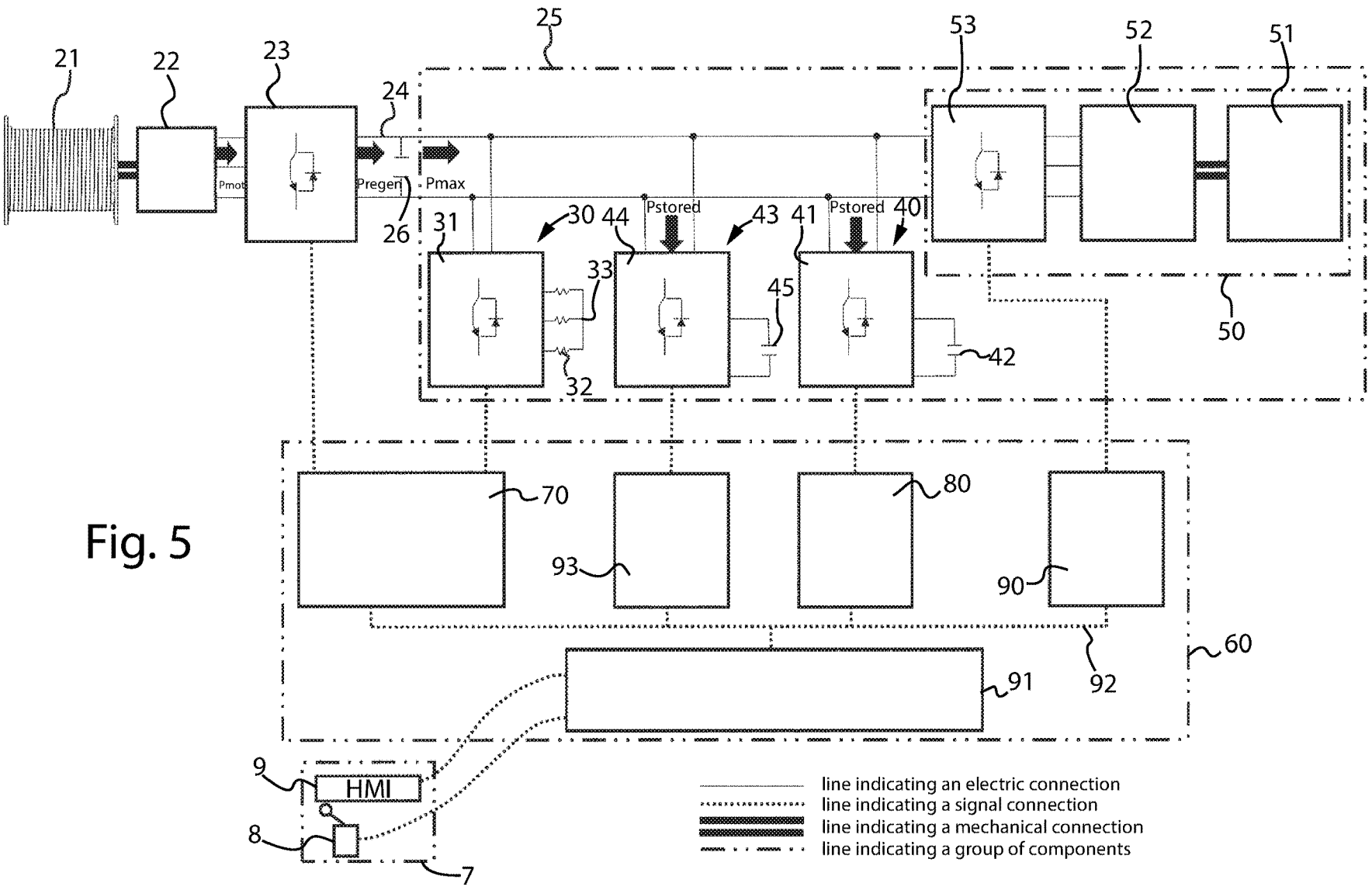
FIG. 5 is a block diagram illustrating a moving device, a first electric motor, a first bidirectional electric power converter device, an electric energy transmission network, a control system, a control group and an electric power use unit which are comprised in the drilling machine of FIG. 1 and configured according to a further variant of the first embodiment of the present invention.

FIG. 5 shows a third variant of the first embodiment of the drilling machine 1. Differently from what has been described with reference to the previous figures, in the third variant of the first embodiment of the drilling machine 1 the electric power use unit 25 further comprises at least one dissipative electric braking system 30. This dissipative electric braking system 30 comprises at least one fifth electric power converter device 31 comprising electronic power devices controllable by means of electric control signals, such as for example thyristors (SCR, GTO) or transistors (IGBT, FET, MOSFET, BJT), and at least one resistor 32. In particular, FIG. 5 shows a dissipative electric braking system 30 comprising only one fifth electric power converter device 31 but the dissipative electric braking system 30 could indifferently comprise a plurality of fifth electric power converter devices 31 comprising electronic power devices controllable by means of electric control signals. In addition, although FIG. 5 shows a dissipative electric braking system 30 comprising a multi-phase system of resistors 33, the dissipative electric braking system 30 could indifferently comprise only one resistor 32. This resistor 32 is configured to convert at least part of the converted electric power Pregen into thermal power. Since the instantaneous value of the converted electric power Pregen derives from the instantaneous value of the electric power produced Pmot by said first electric motor 22 and from the efficiency of the first bidirectional electric power converter device 23, the at least one resistor 32 is configured to convert into thermal power at least part of the electric power produced Pmot by the first electric motor 22 during at least one lowering stroke at a controlled speed of the drilling string 12 inside the hole 61. Differently from what has been described with reference to the previous figures, the first embedded control unit 70 is associated with the fifth electric power converter device 31 in addition to being associated with the first bidirectional electric power converter device 23. In addition to what has been described previously, according to the third variant of the first embodiment of the drilling machine 1, the control program of the first embedded control unit 70 also comprises a second link voltage regulating module and a third module for generating electric control signals. The second link voltage regulating module is configured to determine the instantaneous value of the voltage of the link Vlink and compare this instantaneous value with a second reference value of the voltage of the link Vlinkref2. The second link voltage regulating module is further configured to generate a second control value of the voltage of the link based on this comparison. The third module for generating electric control signals is configured to send fifth electric control signals to the controllable electronic power devices of the fifth electric power converter device 31 based on at least the second control value of the voltage of the link so that the at least one resistor 32 converts into thermal power at least part of the converted electric power Pregen. By sending the fifth electric control signals, the first embedded control unit 70 is electrically associated with this fifth electric power converter device 31. The real-time distributed control system 60 is arranged to control the moving device 21 during a lowering stroke of the drilling string 12 at controlled speed by means of the second electric control signals, the third electric control signals, the fifth electric control signals and the sixth electric control signals. The real-time distributed control system 60 is arranged to control the moving device 21 during a lifting stroke of the drilling string 12 by means of the second electric control signals, the third electric control signals, the fourth electric control signals and the sixth electric control signals. Although FIG. 5 shows by way of example a plurality of electric energy storage systems 40, 43, it should be understood that in the third variant of the first embodiment the electric power use unit 25 can also comprise only one electric energy storage system 40. It should also be understood that the drilling machine 1 according to the third variant of the first embodiment may comprise an electric power use unit 25 comprising a plurality of dissipative electric braking systems, thus comprising a plurality of corresponding fifth electric power converter devices and a plurality of resistors or a plurality of multi-phase resistor systems.

The third variant of the first embodiment as described above makes it possible to further improve the productivity of the drilling machine 1 while solving the problems present in the known types of drilling machines. If the electric power use unit 25 comprises only one electric energy storage system 40, it is possible to increase the productivity of the drilling machine 1 even if a malfunction of this electric energy storage system 40 and/or of the second embedded control unit 80 occurs. In fact, if a malfunction of the first electric energy storage system 40 occurs during the lowering into the hole at a controlled speed of the drilling string, the second embedded control unit 80 can be advantageously configured to send to the first embedded control unit 70 and/or to the central control unit 91 at least some communication data representative of this malfunction situation by means of the communication system 92. For example, due to a malfunction of the first electric energy storage system 40, the second embedded control unit 80 could determine a reduced value, as a limit equal to zero, of the instantaneous value of the stored electric power Pstored and send to the first embedded control unit 70 and/or to the central control unit 91 the communication data representative of this reduced value, by means of the communication system 92. The first embedded control unit 70 and/or the central control unit 91 could compare this reduced value with the instantaneous value of the electric power produced Pmot or converted Pregen, both determined by the first embedded control unit 70, and, if they differ substantially from this reduced value, would identify such communication data as representative of the malfunction situation. Alternatively or additionally, following a malfunction of the first storage system 40, for example because the instantaneous value of at least one temperature of the first storage unit 42 has exceeded a maximum allowed value, the second embedded control unit 80 could determine a reduced value, as a limit equal to zero, of the maximum permissible value of the stored electric power Pstored and send, by means of the communication system 92, to the first embedded control unit 70 and/or to the central control unit 91 this reduced value together with communication data representative of the malfunction situation. If a malfunction of the second embedded control unit 80 occurs, the central control unit 91 can be advantageously configured to send to the first embedded control unit 70 at least some communication data representative of this malfunction situation by means of the communication system 92. On the basis of such communication data representative of the malfunction situation of the first electric energy storage system 40 and/or of the second embedded control unit 80, the third module for generating electric control signals sends fifth electric control signals to the controllable electronic power devices of the fifth electric power converter device 31 such that the at least one resistor 32 converts all the converted electric power Pregen into thermal power. In this way the working cycle of the drilling machine 1 is not interrupted, since it is not necessary to completely stop the lowering of the drilling string 12 by means of the mechanical parking brake, thus further increasing the productivity of the drilling machine 1 with respect to the known types of drilling machines.

If the electric power use unit 25 comprises a plurality of electric energy storage systems 40,43, it is possible to further increase the productivity of the drilling machine 1 even if a malfunction of the second electric energy storage system 43 and/or of the fourth embedded control unit 93 occurs. If a malfunction of the second electric energy storage system 43 occurs, the fourth embedded control unit 93 can be advantageously configured to send to the first embedded control unit 70 and/or to the central control unit 91 at least some communication data representative of such a malfunction situation by means of the communication system 92. If a malfunction of the fourth embedded control unit 93 occurs, the central control unit 91 can be advantageously configured to send to the first embedded control unit 70 at least some communication data representative of this malfunction situation by means of the communication system 92. On the basis of such communication data representative of the malfunction situation of the second electric energy storage system 43 and/or of the fourth embedded control unit 93, the third module for generating electric control signals sends fifth electric control signals to the controllable electronic power devices of the fifth electric power converter device such that the at least one resistor 32 converts at least part of the converted electric power Pregen into thermal power. In particular, the value of the electric power converted by the at least one resistor 32 into thermal power is at least equal to the instantaneous value of the electric power stored Pstored in this second electric energy storage system 43 immediately before or at the time of the malfunction of the second electric energy storage system 43 and/or of the fourth embedded control unit 93. In this way it is advantageously possible, also following a malfunction situation, to further increase the maximum value of the controlled lowering speed of the drilling string 12 inside the hole and therefore it is possible to further increase the productivity of the drilling machine 1 with respect to the known types of drilling machines.

In addition, it is advantageously possible to further increase the drilling depth reachable by the drilling string 12, thus increasing the productivity of the drilling machine 1, for a predetermined size of the components used in the first electric energy storage system 40 and/or for a predetermined size of the components used in the second electric energy storage system 43. To this end, the control program of the second embedded control unit 80 also comprises a first charge state determination module configured to determine the instantaneous value of the state of charge SOCinst1 of the first storage unit 42. Similarly, the control program of the fourth embedded control unit 93 also comprises a second charge state determination module configured to determine the instantaneous value of the state of charge SOCinst2 of the second storage unit 45. The first charge state determination module is further configured to compare the instantaneous value of the state of charge SOCinst1 of the first storage unit 42 with at least a maximum value of the state of charge SOCmax1 of this first storage unit 42 and it is configured to generate a first control value of the state of charge of the first storage unit 42 on the basis of this comparison. Similarly, the second charge state determination module is further configured to compare the instantaneous value of the state of charge SOCinst2 of the second storage unit 45 with at least a maximum value of the state of charge SOCmax2 of this second storage unit 45 and it is configured to generate a second control value of the state of charge of the second storage unit 45 on the basis of this comparison. If the second embedded control unit 80 comprises the first module for determining the stored electric power configured to determine the instantaneous value of the electric power stored Pstored in the first electric energy storage system 40 and/or to determine a maximum permissible value of the electric power stored Pstored in the first electric energy storage system 40, these values can also be determined based on the instantaneous value of the state of charge SOCinst1 or based on the first control value of the state of charge of the first storage unit 42.

In particular, the first module for determining the stored electric power is configured to generate, based on the first control value of the state of charge of the first storage unit 42, a control value of the electric power stored Pstored in the first electric energy storage system 40. Thus, the second module for generating electric control signals is configured to generate and send the third electric control signals to the controllable electronic power devices of the second bidirectional electric power converter device 41 based on at least this control value of the stored electric power Pstored so that the second bidirectional electric power converter device 41 controls the instantaneous value of the electric power stored Pstored in the first electric energy storage system 40 on the basis of at least the instantaneous value of the state of charge SOCinst1 of the first storage unit 42.

It will therefore be understood that the second embedded control unit 80 is configured to determine and send to the first embedded control unit 70, by means of communication data transferred by the communication system 92, the instantaneous value of the electric power stored Pstored in the first electric energy storage system 40 and/or the maximum permissible value of the electric power stored Pstored in the first electric energy storage system 40.

Similarly, if the fourth embedded control unit 93 comprises the second module for determining the stored electric power configured to determine the instantaneous value of the electric power stored Pstored in the second electric energy storage system 43 and/or to determine a maximum permissible value of the electric power stored Pstored in the second electric energy storage system 43, these values can also be determined based on the instantaneous value of the state of charge SOCinst2 or based on the second control value of the state of charge of the second storage unit 45. In this case, the fourth bidirectional electric power converter device 44 controls the instantaneous value of the electric power stored Pstored in the second electric energy storage system 43 on the basis of at least the instantaneous value of the state of charge SOCinst2 of the second storage unit 45. Moreover, the fourth embedded control unit 93 is configured to determine and send to the first embedded control unit 70, by means of communication data transferred by the communication system 92, the instantaneous value of the electric power stored Pstored in the second electric energy storage system 43 and/or the maximum permissible value of the electric power stored Pstored in the second electric energy storage system 43. To further increase the drilling depth reachable by the drilling string 12 for a predetermined size of the components used in the first electric energy storage system 40 and/or for a predetermined size of the components used in the second electric energy storage system 43, the second embedded control unit 80 and/or the fourth embedded control unit 93 and/or the central control unit 91 are configured to send to the first embedded control unit 70 this first control value of the state of charge of the first storage unit 42 and/or this second control value of the state of charge of the second storage unit 45 by means of communication data transferred by the communication system 92. The first embedded control unit 70 is therefore configured to send fifth electric control signals to the controllable electronic power devices of the fifth electric power converter device 31 on the basis of such communication data so that the dissipative electric braking system 30, in particular the at least one resistor 32, converts into thermal power at least part of the converted electric power Pregen, based on the instantaneous value of the state of charge SOCinst1 of the first storage unit 42 and/or based on the instantaneous value of the state of charge SOCinst2 of the second storage unit 45. Since the instantaneous value of the converted electric power Pregen derives from the instantaneous value of the electric power produced Pmot by the first electric motor 22 and from the efficiency of the first bidirectional electric power converter device 23, it will be understood that the dissipative electric braking system 30, in particular the at least one resistor 32, converts into thermal power at least part of the electric power produced "Pmot" by said first electric motor 22 on the basis of the instantaneous value of the state of charge SOCinst1 of the first storage unit 42 and/or on the basis of the instantaneous value of the state of charge SOCinst2 of the second storage unit 45. In particular, by sending such communication data and by means of the fifth electric control signals, it is advantageously possible that the at least one resistor 32 converts into thermal power all the electric power converted Pregen by said first bidirectional electric power converter device 23, therefore all the electric power produced Pmot by said first electric motor 22, when the instantaneous value of the state of charge SOCinst1 of the first storage unit 42 and/or the instantaneous value of the state of charge SOCinst2 of the second storage unit 45 are respectively greater than the maximum value of the state of charge SOCmax1 of such first storage unit 42 and the maximum value of the state of charge SOCmax2 of such second storage unit 45. In this way it is advantageously possible for the drilling machine 1 to reach greater drilling depths than those which can be reached for a predetermined size, in particular for a predetermined energy capacity, of the components used in the first storage system 42 and/or of the components used in the second storage system 45. In particular, by means of the dissipative electric braking system 30 it is possible to reach a drilling depth with a value totally independent of the predetermined size, in particular the predetermined energy capacity, of the components used in the first storage system 42 and/or of the components used in the second storage system 45. By means of the second link voltage regulating module, it is possible to guarantee that the voltage of the link 24 is always maintained within a predetermined range comprised between a minimum value and a maximum value of the voltage of the link, even when the instantaneous value of the state of charge SOCinst1 of the first storage unit 42 and/or the instantaneous value of the state of charge SOCinst2 of the second storage unit 45 are respectively greater than the maximum value of the state of charge SOCmax1 of this first storage unit 42 and the maximum value of the state of charge SOCmax2 of this second storage unit 45. By way of example, by using a second reference value of the voltage of the link Vlinkref2 greater than or equal to the first reference value of the voltage of the link Vlinkref1, it is possible to guarantee that the voltage of the link 24 has always a value smaller than a suitable maximum value even when the instantaneous value of the state of charge SOCinst1 of the first storage unit 42 and/or the instantaneous value of the state of charge SOCinst2 of the second storage unit 45 are respectively greater than the maximum value of the state of charge SOCmax1 of this first storage unit 42 and the maximum value of the state of charge SOCmax2 of this second storage unit 45.

In a variant, the fifth electric power converter device 31 or the plurality of fifth electric power converter devices 31 can be associated with a fifth embedded control unit instead of being associated with the first embedded control unit 70. In particular, this fifth embedded control unit is electrically associated with the fifth electric power converter device 31 or with the plurality of fifth electric power converter devices 31 by sending the fifth electric control signals. In this variant, it is the fifth embedded control unit that comprises the second link voltage regulating module and the third module for generating electric control signals. The communication system 92 is electrically connected to the first embedded control unit 70, to the second embedded control unit 80, to the third embedded control unit 90, to the fourth embedded control unit 93, to the fifth embedded control unit and to the central control unit 91. In this way, this communication system 92 is arranged to transfer the communication data between the embedded control units 70, 80, 90, 93, and the fifth embedded control unit and between each embedded control unit 70, 80, 90, 93, the fifth embedded control unit and the central control unit 91. In particular, the communication system 92 is arranged to transfer to the fifth embedded control unit the communication data representative of a malfunction situation of the first electric energy storage system 40 and/or of the second embedded control unit 80 and/or of the second electric energy storage system 43 and/or of the fourth embedded control unit 93. In addition, the communication system 92 is arranged to transfer to the fifth embedded control unit the communication data representative of the first control value of the state of charge of the first storage unit 42 and/or of the second control value of the state of charge of the second storage unit 45. Alternatively or additionally, the communication system 92 is arranged to transfer to the fifth embedded control unit the instantaneous value of the electric power stored Pstored in the first electric energy storage system 40 and/or in the second electric energy storage system 43 and/or a maximum permissible value of the electric power stored Pstored in the first electric energy storage system 40 and/or in the second electric energy storage system 43.

Figure 6:
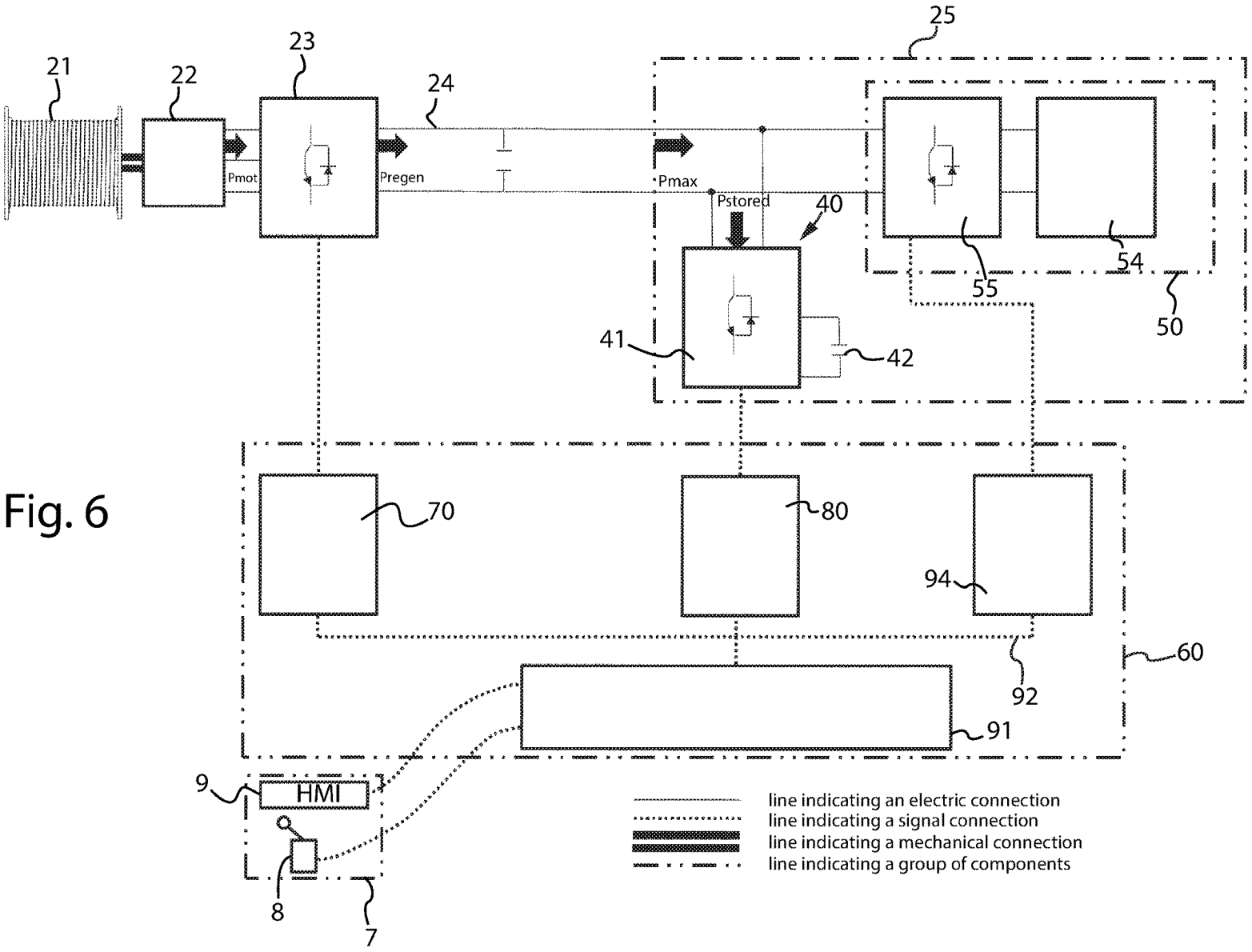
FIG. 6 is a block diagram illustrating a moving device, a first electric motor, a first bidirectional electric power converter device, an electric energy transmission network, a control system, a control group and an electric power use unit which are comprised in the drilling machine of FIG. 1 and configured according to a second embodiment of the present invention.

The drilling machine 1 according to a second embodiment is shown in FIG. 6 with reference to the drilling performed by means of the so-called drilling technique indicated as LDP. As far as the numbering of FIG. 6 is concerned, it should be understood that the same components described above with reference to the first embodiment and its variants are indicated in FIG. 6 by adopting the same numbers. For these components it must therefore be understood that what has been previously described both with reference to the first embodiment and with reference to the different variants remains valid.

A description will therefore be given below of the components which differ with respect to the first embodiment. Differently from the first embodiment of the drilling machine 1, the electric power use unit 25 according to the second embodiment comprises a prime motor configured to generate electric power 50 comprising a fuel cell 54 and a sixth electric power converter device 55, comprising electronic power devices controllable by means of electric control signals such as for example thyristors (SCR, GTO) or transistors (IGBT, FET, MOSFET, BJT), electrically associated with said fuel cell 54. The real-time distributed control system 60 arranged to control the movement of the moving device 21 comprises in addition to the central control unit 91, to the communication system 92, to the first embedded control unit 70 and to the second embedded control unit 80, also a sixth embedded control unit 94 associated with the sixth electric power converter device 55. The communication system 92 is arranged to transfer the communication data between the embedded control units 70, 80, 94 and between each embedded control unit 70, 80, 94 and the central control unit 91. The sixth embedded control unit 94 is configured to send seventh electric control signals to the controllable electronic power devices of the sixth electric power converter device 55 so that the prime motor configured to generate electric power sends, through the electric energy transmission network 24, electric power to the first bidirectional electric power converter device 23 and thus to the first electric motor 22 during at least one lifting stroke towards ground level 62 of the drilling string 12 inside the hole 61. This first electric motor 22 is configured to, in a first operating mode, actuate the moving device 21 so as to lift the drilling string 12, by means of the flexible tensile element 17. In said first operating mode, the first electric motor 22 converts into mechanical driving power the electric power sent by the first electric energy storage system and by the prime motor configured to generate electric power 50 and applies said mechanical driving power to the moving device 21 to lift the drilling string 12 and perform a lifting stroke. By sending the seventh electric control signals, the sixth embedded control unit 94 is electrically associated with this sixth electric power converter device 55. The real-time distributed control system 60 is arranged to control the moving device 21 during a lifting stroke of the drilling string 12 by means of the second electric control signals, the third electric control signals and the seventh electric control signals. This sixth embedded control unit 94 is designed to control the fuel cell 54 by means of the sixth electric power converter device 55 and to superintend safety functions related to the correct operation of this sixth electric power converter device 55 and of the cell fuel 54. Advantageously but not limitedly, in the second embodiment of the present invention, the sixth electric power converter device 55 and the sixth embedded control unit 94 are housed inside a fourth common enclosure, for example an electrical switchboard, an electrical box or an electrical cabinet of the known type. During the lifting stroke of the drilling string 12 towards ground level, the sixth embedded control unit 94 is configured to send the seventh electric control signals to the sixth electric power converter device 55 so that said prime motor configured to generate electric energy 50 sends electric power to the first bidirectional electric power converter device 23 and thus to the first electric motor 22 by means of the link 24. In particular, this sixth electric power converter device 55 could be of the unidirectional type, i.e. able to make the electric power flow only from the fuel cell 54 towards the link 24, or it could be of the bidirectional type, i.e. able to make the electric power flow both from the fuel cell 54 towards the link 24 and from the link 24 towards the fuel cell 54. This sixth electric power converter device 55 allows the chemical energy of a fuel, for example hydrogen, to be used during the lifting stroke of the drilling string 12 towards ground level 62. In particular, in the second embodiment of the drilling machine 1, the chemical energy of the fuel is transformed into electric energy by the fuel cell 54. By sending the seventh electric control signals and the third electric control signals, the prime motor configured to generate electric power 50 and the first electric energy storage system 40 send electric power to the first electric motor 22 during a lifting stroke of the drilling string 12.

If the prime motor configured to generate electric power 50 is mechanically associated with the supporting structure 3, it is advantageous to use a liquid cooling system also for the sixth electric power converter device 55, for the fuel cell 54 and for the sixth embedded control unit 94. If the prime motor configured to generate electric power 50 is not mechanically associated with the supporting structure 3 but it is only electrically connected to the electric energy transmission network 24, it is possible to use an air cooling system for the fuel cell 54 and/or for the sixth electric power converter device 55 and/or for the sixth embedded control unit 94.

From the above description the features of the drilling machine of the present invention, as well as the advantages thereof, are evident.

Finally, it is clear that the drilling machine as conceived herein is susceptible to many modifications and variations; furthermore, all the details are replaceable by technically equivalent elements. In practice, the materials used, as well as the dimensions, can be of any type according to the technical requirements.

The invention claimed is:

1. A drilling machine configured to drill a hole in the ground, the drilling machine comprising:

a supporting structure comprising a frame and a mast;

a drilling string comprising at least a drilling tool and being able to be actuated to drill said hole;

a drilling head configured to translate in a guided manner along said mast and motorised to give a rotational motion and/or a translational motion to said drilling string;

a flexible tensile element connected to said drilling string;

a moving device mechanically connected to the supporting structure and mechanically associated with said flexible tensile element to hold and move said drilling string along a substantially longitudinal direction of said hole by means of said flexible tensile element;

at least one first electric motor, mechanically connected to said moving device, configured to, in a first operating mode, actuate said moving device so as to lift said drilling string by means of said flexible tensile element, and configured to, in a second operating mode, apply a braking mechanical power on said moving device so as to brake in a controlled manner, by means of said flexible tensile element, the lowering of said drilling string to reach and maintain a desired controlled lowering speed (Vd), said at least one first electric motor being also configured to produce, in said second operating mode, an electric power (Pmot);

a first bidirectional electric power converter device electrically connected to said first electric motor and configured to convert said electric power produced (Pmot) by said first electric motor into converted electric power (Pregen);

an electric energy transmission network electrically connected to said first bidirectional electric power converter device and arranged to transmit said converted electric power (Pregen);

an electric power use unit electrically connected to said electric energy transmission network and arranged to receive said electric power converted (Pregen) by said first bidirectional electric power converter device and transmitted by said electric energy transmission network, said electric power use unit comprising at least one first electric energy storage system and a prime motor configured to generate electric power;

a control group configured to send at least one first electric control signal representative of the value of the desired controlled lowering speed (Vd) of said drilling tool;

a control system configured to receive said first electric control signal, generate second electric control signals based on such a first electric control signal and send said second electric control signals to said first bidirectional electric power converter device, said first bidirectional electric power converter device being configured to control the operation of said first electric motor based on said second electric control signals received from said control system, so that said drilling string carries out the lowering at said desired controlled lowering speed (Vd), said control system being of the distributed and real-time type;

wherein said control system comprises at least a first embedded control unit associated with said first bidirectional electric power converter device, said first embedded control unit being configured to receive said first electric control signal, generate second electric control signals based on such a first electric control signal and send said second electric control signals to said first bidirectional electric power converter device, said first embedded control unit being configured to limit said electric power produced (Pmot) by said first electric motor to a value not greater than the maximum electric power usable (Pmax) by said electric power use unit; and wherein said first embedded control unit is configured to determine a maximum value of the controlled lowering speed (Vmax) of the drilling string based on at least one parameter selected from the group consisting of the position of the drilling tool (Pos), the instantaneous weight acting on the flexible tensile element (Weight), the type of drilling technique used, the type of drilling tool used (Tool), the energy efficiency of the first electric motor (Eff), the maximum permissible rotational speed of the moving device or of a gearbox mechanically associated with such a moving device (Nmax1), the maximum permissible rotational speed of the first electric motor (Nmax2), and the maximum electric power usable by the electric power use unit (Pmax), said first embedded control unit being configured to determine the value of a desired maximum speed (Vdmax) based on the comparison between the desired value of the controlled lowering speed (Vd) and the previously determined maximum value of the controlled lowering speed (Vmax), said first embedded control unit being also configured to generate said second electric control signals based on the value of the desired maximum speed (Vdmax).

2. The drilling machine according to claim 1, wherein said first embedded control unit is configured to determine a maximum value of the lowering acceleration and/or lowering deceleration (Amax) of the drilling tool based on at least one parameter selected from the group consisting of:

the position of the drilling tool (Pos), the instantaneous weight acting on the flexible tensile element (Weight), the type of drilling technique used, and the type of drilling tool used (Tool), said first embedded control unit being configured to determine an admissible value of the desired controlled lowering speed (Vdadm) based on the comparison between the value of a desired acceleration or desired deceleration (Ad), determined based on the desired value of the controlled lowering speed (Vd), and the maximum value of the lowering acceleration and/or lowering deceleration (Amax) previously determined.

3. The drilling machine according to claim 1, wherein said electric power use unit comprises a plurality of electric energy storage systems.

4. The drilling machine according to claim 1, wherein said at least one first electric energy storage system comprises at least one second bidirectional electric power converter device and at least one first storage unit associated with said at least one second bidirectional electric power converter device, said control system comprising at least one second embedded control unit associated with said at least one second bidirectional electric power converter device, said at least one second embedded control unit being configured to send third electric control signals to said at least one second bidirectional electric power converter device so as to control the instantaneous value of the electric power stored (Pstored) in said at least one first electric energy storage system based on said converted electric power (Pregen) during at least one lowering stroke of the drilling string and so as to send electric power from said at least one first storage system to said first electric motor during at least one lifting stroke of said drilling string.

5. The drilling machine according to claim 4, wherein said first embedded control unit is configured to determine the instantaneous value of the electric power produced (Pmot) by said first electric motor and/or the instantaneous value of the electric power converted (Pregen) by said first bidirectional electric power converter device and transmitted by the electric energy transmission network, said first embedded control unit being configured to send at least one determined instantaneous value (Pmot, Pregen) to said at least one second embedded control unit, said at least one second embedded control unit being configured to send the third electric control signals to said at least one second bidirectional electric power converter device so as to control the instantaneous value of the electric power stored (Pstored) in said at least one first electric energy storage system based on said at least one instantaneous value determined (Pmot, Pregen) by said first embedded control unit.

6. The drilling machine according to claim 4, wherein said at least one first storage unit is a first unit of supercapacitors or it is a first unit of secondary batteries.

7. The drilling machine according to claim 4, wherein said at least one second bidirectional electric power converter device is of the multi-phase type and said at least one second embedded control unit is configured to:

determine the instantaneous value (Vlink) of the voltage of the electric energy transmission network, compare such an instantaneous value with a first reference value (Vlinkref1) of the voltage of the electric energy transmission network and generate a first control value of the voltage of the electric energy transmission network based on such a comparison, measure the value of the current that flows in each phase of said at least one second bidirectional electric power converter device and limit said value of the current that flows in each phase to a value not greater than a maximum permissible value of the phase current, send third electric control signals to said at least one second bidirectional electric power converter device based on at least one parameter among the first control value of the voltage and the maximum permissible value of the phase current so as to control the instantaneous value of the electric power stored (Pstored) in said at least one first electric energy storage system.

8. The drilling machine according to claim 4, further comprising a liquid cooling system at least for said first electric motor, for said first bidirectional electric power converter device, for said at least one second bidirectional electric power converter device, for said at least one first storage unit, for said first embedded control unit and for said at least one second embedded control unit.

9. The drilling machine according to claim 1, wherein said first embedded control unit comprises a controller and is configured to vary the value of characteristic parameters of such controller based on the instantaneous weight acting on the flexible tensile element (Weight) or based on parameters representative of the geometry of said drilling string.

10. The drilling machine according to claim 1, wherein said prime motor configured to generate electric power comprises a combustion engine, a second electric motor mechanically connected to said combustion engine and a third electric power converter device electrically associated with said second electric motor, said control system comprising a third embedded control unit associated with said third electric power converter device, said third embedded control unit being configured to send fourth electric control signals to said third electric power converter device so that said prime motor configured to generate electric power sends electric power to said first electric motor during at least one lifting stroke of said drilling string.

11. The drilling machine according to claim 1, wherein said prime motor configured to generate electric power comprises a fuel cell and a sixth electric power converter device electrically associated with said fuel cell, said control system comprising a sixth embedded control unit associated with said sixth electric power converter device, said sixth embedded control unit being configured to send seventh electric control signals to said sixth electric power converter device so that said prime motor configured to generate electric power sends electric power to said first electric motor during at least one lifting stroke of said drilling string.

12. The drilling machine according to claim 1, wherein said electric power use unit comprises at least one dissipative electric braking system comprising at least one fifth electric power converter device and at least one resistor configured to convert into thermal power at least part of the electric power converted (Pregen) by said first bidirectional electric power converter device, said first embedded control unit also being associated with said at least one fifth electric power converter device and being configured to:

determine the instantaneous value of the voltage (Vlink) of the electric energy transmission network, compare such a determined instantaneous value with a second reference value (Vlinkref2) of the voltage of the electric energy transmission network, generate a second control value of the voltage of the electric energy transmission network based on such a comparison, send fifth electric control signals to said at least one fifth electric power converter device based on at least the second control value of the voltage so that said at least one resistor converts into thermal power at least part of the converted electric power (Pregen).

13. The drilling machine according to claim 12, wherein said at least one first electric energy storage system comprises at least one second bidirectional electric power converter device and at least one first storage unit associated with said at least one second bidirectional electric power converter device, and wherein said at least one dissipative electric braking system converts into thermal power at least part of the electric power converted (Pregen) by said first bidirectional electric power converter device based on an instantaneous value representative of the state of charge (SOCinst1) of said at least one first storage unit.

14. The drilling machine according to claim 1, wherein said control system comprises a central control unit configured to verify the compatibility of said first electric control signal with an operating status of the drilling machine, said first embedded control unit processing said first electric control signal only following said verification of compatibility.

15. The drilling machine according to claim 1, wherein said first embedded control unit comprises a group of calculation instructions which implements a calculation method configured to determine the instantaneous angular position (Posrot) and the instantaneous angular speed (Vrot) of the rotor of said first electric motor also at very low or zero instantaneous angular speed, so that said first electric motor brakes said moving device to hold said drilling string at zero instantaneous lowering speed (Vinst) by means of the flexible tensile element, said first embedded control unit being configured to determine the position of the drilling tool (Pos) based on such an instantaneous angular position (Posrot) of the rotor of said first electric motor.

* * * * *